US012264486B1

(12) United States Patent
Bond

(10) Patent No.: US 12,264,486 B1
(45) Date of Patent: Apr. 1, 2025

(54) HIGH-CAPACITY BEAM AND MODULAR GRID SHORING SYSTEMS

(71) Applicant: Bond Formwork Systems, LLC, Waller, TX (US)

(72) Inventor: Bradley D. A. Bond, Katy, TX (US)

(73) Assignee: Bond Formwork Systems, LLC, Waller, TX (US)

( * ) Notice: Subject to any disclaimer, the term of this patent is extended or adjusted under 35 U.S.C. 154(b) by 0 days.

(21) Appl. No.: 18/830,178

(22) Filed: Sep. 10, 2024

(51) Int. Cl.

| | |
|---|---|
| ***E04G 11/50*** | (2006.01) |
| ***E04G 11/48*** | (2006.01) |
| ***E04G 25/02*** | (2006.01) |
| *E04G 25/00* | (2006.01) |

(52) U.S. Cl.
CPC ..... *E04G 11/50* (2013.01); *E04G 11/486* (2013.01); *E04G 25/02* (2013.01); *E04G 2025/003* (2013.01)

(58) Field of Classification Search
CPC ..... E04G 11/50; E04G 11/52; E04G 11/54; E04C 2003/043
See application file for complete search history.

(56) References Cited

U.S. PATENT DOCUMENTS

| | | | | |
|---|---|---|---|---|
| 10,024,069 | B2 | 7/2018 | Bond et al. | |
| 10,407,925 | B2 * | 9/2019 | Baron | E04G 25/065 |
| 10,487,521 | B2 | 11/2019 | Baron et al. | |
| 10,711,472 | B2 | 7/2020 | Bond | |
| 10,982,452 | B1 | 4/2021 | Bond | |
| 11,047,142 | B1 * | 6/2021 | Bond | E04G 11/483 |
| 11,268,289 | B2 | 3/2022 | Bond | |
| 11,473,321 | B2 * | 10/2022 | Bond | E04G 11/38 |
| 11,585,105 | B2 | 2/2023 | Bond | |
| 11,952,789 | B1 | 4/2024 | Bond | |
| 2009/0212195 | A1 * | 8/2009 | Arocena Bergareche | E04G 11/486 249/13 |
| 2019/0010717 | A1 * | 1/2019 | Baron | E04G 11/52 |
| 2021/0079670 | A1 * | 3/2021 | Becker | E04G 11/38 |

(Continued)

FOREIGN PATENT DOCUMENTS

| | | | | |
|---|---|---|---|---|
| FR | 2821104 | A1 * | 8/2002 | E04G 11/486 |

OTHER PUBLICATIONS

Atlas A-Deck User Guide_2019.

*Primary Examiner* — Christine T Cajilig
(74) *Attorney, Agent, or Firm* — Mehrman Law Office; Michael J. Mehrman

(57) ABSTRACT

A high-capacity beam includes interoperable features conformant with the pretexting modular grid shoring system including conformant interface rails and conformant end caps that removably engage with the conformant interface rails. The truss portion of the high-capacity beam has the same width and a greater height compared to the truss portion of the low-capacity beam. The high-capacity beam may also include a conformant T-slot and beveled end faces on respective opposing sides of the high-capacity truss portion. A nominal 8-foot length of the modular high-capacity beam weighs less than about 50 lbs., while a nominal 6-foot length of the low-capacity beam weighs less than about 40 lbs. A grid shoring assembly utilizing the high-capacity main beams is rated for supporting a nominal 13-inch concrete platform, while a grid shoring assembly utilizing the low-capacity main beams is rated for supporting a nominal 6-inch concrete platform.

20 Claims, 19 Drawing Sheets

(56) References Cited

U.S. PATENT DOCUMENTS

| | | | | |
|---|---|---|---|---|
| 2022/0034105 | A1* | 2/2022 | Bond | E04G 11/483 |
| 2023/0243166 | A1* | 8/2023 | Faresin | E04G 11/486 248/351 |

* cited by examiner

HIGH-CAPACITY BEAM AND MODULAR GRID SHORING SYSTEMS

TECHNICAL FIELD

This disclosure is related to modular grid shoring systems for building construction and, more particularly, to a high-capacity beam and modular grid shoring assemblies utilizing high-capacity beams.

BACKGROUND

U.S. Pat. Nos. 10,024,069; 10,711,472; 10,982,452; 11,047,142; 11,268,289; 11,473,321; 11,585,105; 11,952,789 and 12,071,774; and U.S. patent application Ser. No. 18/742,599 filed 2024 Jun. 13, which are incorporated by reference, describe modular grid shoring systems utilizing modular, interoperable components including beams, joists, props, drop heads, clips, prop positioners, and other components configured to removably engage with each other. A "main beam" generally refers to a beam that supports a number of transverse beams or joists supported along the length of the main beam. Main beams are typically supported by drop heads allowing the main beams to be easily lowered, for example with a hammer strike, to facilitate removal of concrete forms used to support wet concrete structures while the concrete sets. Standard end caps on the ends of the modular beams removably engage with standard interface rails on the modular beams allowing a main beam to receive and support multiple transverse beams or joists along the length of the main beam. The standard end caps are also removably engage with standard beam interfaces on the drop seats of drop heads and other system components. Standard T-slots on the bottom sides of the modular beams and joists removably engage with other system components, such as clips and prop positioners. The modular, interoperable components may thus be readily assembled and disassembled in the field to temporarily fabricate a wide variety of grid shoring assemblies for concrete building fabrication, as needed and where needed, to suit a wide range of concrete fabrication jobs.

Conventional beams of the modular grid shoring system have a limited load-bearing capacity referred to in this disclosure as "low-capacity." More specifically, a nominal 8-foot length of the low-capacity beam weighs less than about 40 lbs., and a grid shoring assembly including main beams formed by nominal 8-foot lengths of these low-capacity beams and nominal 8-foot transverse joists is rated for supporting a nominal 6-inch thick concrete platform. While this is a highly versatile and cost effective grid shoring system, there remains a need for improved, more versatile, and more cost effective modular grid shoring systems.

SUMMARY

A representative embodiment of a high-capacity beam is interoperable with a pretexting modular grid shoring system that includes a set of interoperable modular grid shoring components including a low-capacity beam. Each low-capacity beam includes a conformant interface portion defining a conformant interface rail, a conformant end cap on an end of the conformant interface portion, and a low-capacity truss portion extending from a bottom side of the conformant interface portion defining a maximum height. The high-capacity beam includes an extrusion comprising a hollow frontal face and a beveled end face comprising a comprising a septum wall, the beveled end face disposed at an obtuse angle with respect to the frontal face. A a conformant interface portion defining a conformant interface rail extending in a longitudinal direction, and a conformant end cap positioned in and substantially filling the hollow frontal face. The high-capacity truss portion defining the beveled end face extending from a bottom side of the frontal face, the high-capacity truss portion defining a maximum height greater than the maximum height of the low-capacity truss portion.

According to an aspect of the representative embodiment, the bottom side of the truss portion of the low-capacity beam and the high-capacity beam may each define a conformant T-slot configured to receive certain components of the modular grid shoring system, such as clips and prop positioners. In addition, the representative embodiment of the high-capacity beam may include beveled end faces on respective opposing ends of the high-capacity truss portion.

According to another aspect of the representative embodiment, a nominal 8-foot length of the high-capacity beam weighs less than about 50 lbs., and a nominal 8-foot length of the low-capacity beam weighs less than about 40 lbs. A representative grid shoring assembly including nominal 8-foot lengths of high-capacity main beams and nominal 8-foot transverse joists supported by the high-capacity main beams is rated for supporting a nominal 13-inch thick concrete platform, and a representative grid shoring assembly including nominal 8-foot lengths of low-capacity main beams is rated for supporting a nominal 6-inch thick concrete platform.

It will be understood that specific embodiments may include a variety of features and options in different combinations, as may be desired by different users. Practicing the invention does not require utilization of all, or any particular combination, of these specific features or options. The specific techniques and structures for implementing particular embodiments of the invention and accomplishing the associated advantages will become apparent from the following detailed description of the embodiments and the appended drawings and claims.

The above presents a simplified summary in order to provide a basic understanding of some aspects of the invention. This summary is not an exhaustive overview of the invention. It is not intended to identify key or critical elements of the disclosure or to delineate the scope of the invention. Its sole purpose is to present some concepts in a simplified form as a prelude to the following more detailed description, appended drawings, and claims.

BRIEF DESCRIPTION OF THE DRAWINGS

The numerous advantages of the embodiments of the invention may be better understood with reference to the accompanying figures.

DESCRIPTION OF ILLUSTRATIVE EMBODIMENTS

Figure 1B:
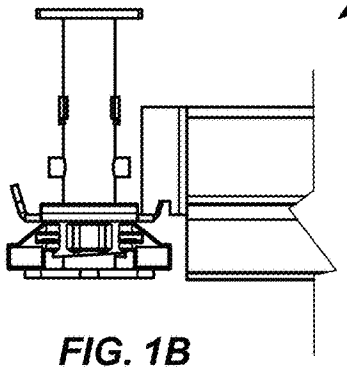
FIG. 1B (PRIOR ART)
FIG. 1B (prior art) is a front view the conventional prop assembly supporting a low-capacity beam in a lower position.

In a representative embodiment, the high-capacity beam is interoperable with a pretexting modular grid shoring system that includes a set of interoperable modular grid shoring system components including a low-capacity beam. The low-capacity beam includes a conformant interface portion defining a conformant interface rail, a conformant end cap on an end of the conformant interface portion, and a high-capacity truss portion extending from a bottom side of the conformant interface portion. The high-capacity beam likewise includes a conformant interface portion defining a conformant interface rail, a conformant end cap on an end of the conformant interface portion, and a high-capacity truss portion extending from a bottom side of the conformant interface portion. However, the truss portion of the high-capacity beam defines a maximum height greater than the maximum height of the low-capacity truss portion. In the representative embodiment, the bottom side of the truss portion of the low-capacity beam and the high-capacity beam each define a conformant T-slot configured to receive certain components of the modular grid shoring system, such as clips and prop positioners. In addition, the representative embodiment of the high-capacity beam includes beveled end faces on respective opposing ends of the high-capacity truss portion.

The representative embodiment of the high-capacity beam is only about 25% heavier than the preexisting low-capacity beam, while exhibiting about double the load-carrying capacity. More specifically, a nominal 8-foot length of the high-capacity beam weighs less than about 50 lbs., and a nominal 8-foot length of the modular low-capacity beam weighs less than about 40 lbs. (i.e., the high-capacity beam is about 25% heavier than the low-capacity beam). Despite this relative different in weight, a grid shoring assembly utilizing the high-capacity main beams is rated for supporting a nominal 13-inch concrete platform, and a grid shoring assembly utilizing the low-capacity main beams is rated for supporting a nominal 6-inch concrete platform. In other words, the high-capacity beam exhibits about double the load-carrying capacity of the low-capacity beam.

This disclosure uses certain nomenclature to describe the components of the representative embodiments. An established convention in the construction industry generally refers to standard board lengths by a name indicating the standard length when the board is not precisely that length. For example, a board length typically referred to as a "6-foot" board has a standard length of approximately 170 cm, which is somewhat less than 6 feet. Similarly, a board length typically referred to as an "8-foot" board has a standard length of approximately 230 cm, which is somewhat less than 8 feet. In this disclosure, a beam with a length typically referred to as a "6-foot" length (i.e., approximately 170 cm) is referred to as a "nominal 6-foot beam." Similarly, a beam with a length typically referred to as an "8-foot" length (i.e., approximately 230 cm) is referred to as a "nominal 8-foot beam." Nevertheless, it will be understood that the length of a "nominal 6-foot beam" or a "nominal 8-foot beam" may vary somewhat from the standard definition as a matter of convention or ordinary variation in components of this type.

This type of shorthand naming convention may also extend to concrete platforms, also commonly referred to as decks. More specifically, a concrete platform generally referred to as a "6-inch platform" has a standard thickness of approximately 15 cm, which is somewhat less than 6 inches. Similarly, a concrete platform generally referred to as a "13-inch platform" has a standard thickness of approximately 33 cm, which is somewhat less than 13 inches. In this disclosure, a "6-inch platform" approximately 15 cm thick is referred to as a "nominal 6-inch platform." Similarly, a "13-inch platform" approximately 33 cm thick is referred to as a "nominal 13-inch platform." Nevertheless, it will be understood that the precise thickness of "nominal 6-inch platform" or a "nominal 13-inch platform" may vary somewhat from the standard definition as a matter of convention or ordinary variation in components of this type.

Another established convention in the grid shoring industry allows at most a quarter-inch vertical deflection when rating the load-carrying capacity of a grid shoring assembly. For example, a grid shoring assembly rated to support a 13-inch concrete platform experiences, according to the convention, no more than a quarter-inch vertical deflection when supporting the 13-inch concrete platform. In this disclosure, a grid shoring assembly described as "rated" to support a specified load generally means the assembly that experience, according to the convention, no more than a quarter-inch vertical deflection when supporting the specified load. Nevertheless, it will be understood that a nominal load-carrying rating may vary somewhat from the standard definition as a matter of convention or ordinary variation in assemblies of this type.

The representative high-capacity beam embodiments descried in this disclosure are "modular" with a preexisting system of "interoperable" grid shoring system components including low-capacity beams, joists, drop heads, props, clips and other components. The preexisting modular grid shoring components rely on standardized interfaces designed to removably engage with each other allowing a wide variety of grid shoring assemblies to be assembled and disassembled in the field to meet the needs of a various construction projects. In part, these standardized components include interface rails defined on the opposing elongated sides of beams and joists, along with end caps attached to the ends of beams and joists shaped to be removably received by the interface rails. This allows, for example, a main beam to support multiple transverse beams or joists along the length of the main beam. The standardized interface rails and end caps also removably engage with interfaces on drop heads, props, and other interoperable system components allowing a wide variety of grid shoring assemblies from the interoperable components.

In this disclosure, a grid shoring system component is described as "conformant" when that component is designed to removably engage with, and is therefore compatible with, the preexisting system of interoperable components. For example, a representative embodiment of the high-capacity beam is described as including a "conformant interface portion" meaning the interface portion is designed to removably engage with, and is therefore compatible with, the preexisting system of interoperable components.

In accordance with this nomenclature, a representative low-capacity beam includes a conformant interface portion and a low-capacity truss portion, while a representative high-capacity beam includes a conformant interface portion and a high-capacity truss portion. The representative embodiment of the high-capacity truss portion has a width that is substantially the same as the width of the low-capacity truss portion, and a height that is substantially greater than the height low-capacity truss portion. The conformant interface portion and the high-capacity truss portion is designed to removably engage with, and therefore compatible with, the preexisting system of interoperable components including the low-capacity beams and the other modular components designed for interoperability with the low-capacity beams, such as joists, drop heads, props, clips, etc.

In the representative embodiments, the conformant interface portion of the high-capacity beam is substantially identical to the conformant interface portion of the low-capacity beam. Nevertheless, the conformant interface portions may vary somewhat provided that interoperability is maintained. In the representative embodiments, the conformant interface portion of the low-capacity beam includes conformant interface rails on opposing sides of the low-capacity beam. Likewise, the conformant interface portion of the high-capacity beam includes conformant interface rails on opposing sides of the high-capacity beam. The conformant end cap of the low-capacity beam includes a conformant rail groove designed to removably engage with the conformant interface rails. Likewise, the conformant end cap of the high-capacity beam includes a conformant rail groove designed to removably engage with the conformant interface rails. In general, the modular grid shoring system may include different types of conformant ends caps, such as end caps for main beams and end caps for joist, that vary somewhat from each other while maintaining interoperability other components of the modular grid shoring system.

The difference between the high-capacity beam and the low-capacity beam thus lies primarily in their respective truss portions. First, the high-capacity truss portion may have a width that is substantially the same as the width of the low-capacity truss portion, and a height that is substantially greater than the height of the low-capacity truss portion. Second, the high-capacity truss portion includes beveled end faces, whereas the low-capacity truss portion does not. In addition, the high-capacity truss portion and the low-capacity truss portion may both define conformant T-slots for receiving certain components of the modular grid shoring system, such as clips and prop positioners.

As a result of these differences, the example high-capacity beam is only about 25% heavier than the example low-capacity beam, while exhibiting about double the load-carrying capacity. More specifically, as noted previously, a nominal 8-foot length of the low-capacity beam weighs less than about 40 lbs., while a nominal 8-foot length of the high-capacity beam weighs less than about 50 lbs. In other words, the modular high-capacity beam is about 25% heavier than the modular low-capacity beam. Despite this different in relative weight, a grid shoring assembly utilizing the low-capacity main beam is rated for supporting a nominal 6-inch concrete platform, and a grid shoring assembly utilizing high-capacity main beam is rated for supporting a nominal 13-inch concrete platform. In other words, the modular high-capacity beam exhibits about double the load-carrying capacity of the modular low-capacity beam. The innovative high-capacity beam thus produces significant improvements in the modular grid shoring system while maintaining backward compatibility with the interoperable components of the preexisting modular grid shoring system.

Figure 1A:
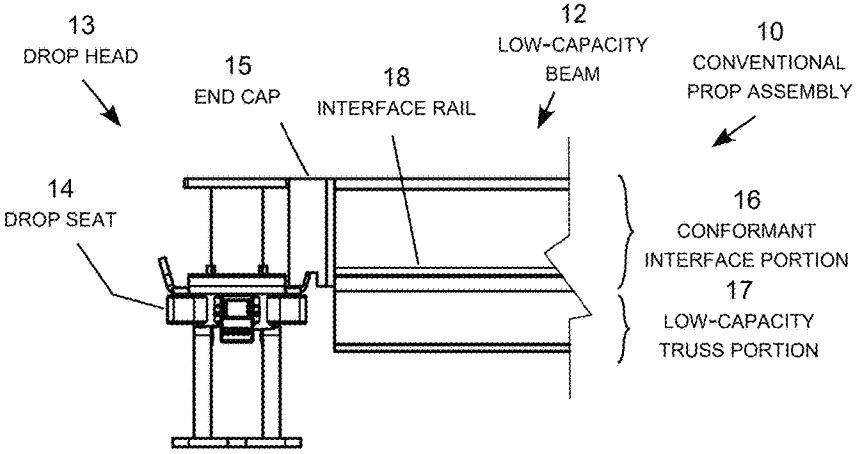
FIG. 1A (PRIOR ART)
FIG. 1A (prior art) is a front view a conventional prop assembly supporting a low-capacity beam in an upper position.

Referring now to the figures, in which like element numerals generally refer to like elements, FIG. 1A (prior art) is a front view of a conventional prop assembly 10 including a low-capacity beam 12 supported by a first type of conventional drop head 13. The drop head 13 includes a drop seat 14 removably engaged with a conformant end cap 15 attached to the end of the low-capacity beam 12. Generally, the low-capacity beam 12 includes a conformant interface portion 16 and a low-capacity truss portion 17. The conformant interface portion 16 includes conformant interface rails on opposing sides of the beam represented by the enumerated conformant interface rail 18. Conformant end caps represented by the conformant end cap 15 are attached to respective opposing ends of the conformant interface portion 16. As described above, the conformant components are designed to removably engage with, and are therefore compatible with, a preexisting system of interoperable components including the low-capacity beams and the other modular components designed for interoperability with the low-capacity beams, such as joists, drop heads, props, clips, etc.

FIG. 1A shows the drop seat 14 supporting the low-capacity beam 12 in an upper position where, for example, the low-capacity beam supports one or more concrete forms fabricate from plywood, sheet metal, plastic or other suitable material. The concrete forms, in turn, support a wet concrete structure, such as a concrete platform, while the concrete sets. Although concrete platforms are utilized in the disclosure to describe the principles of the representative embodiments, it will be understood that a wide range of other structures formed of concrete or another curable material may be fabricated in a similar manner, such as walls, pillars, stair cases, etc. As shown in FIG. 1B (prior art), once the concrete sets sufficiently, the drop seat 14 is lowered, for example by striking a movable component of the drop head with a hammer. This lowers the low-capacity beam 12, to facilitate removal of the concrete forms.

Figure 2B:
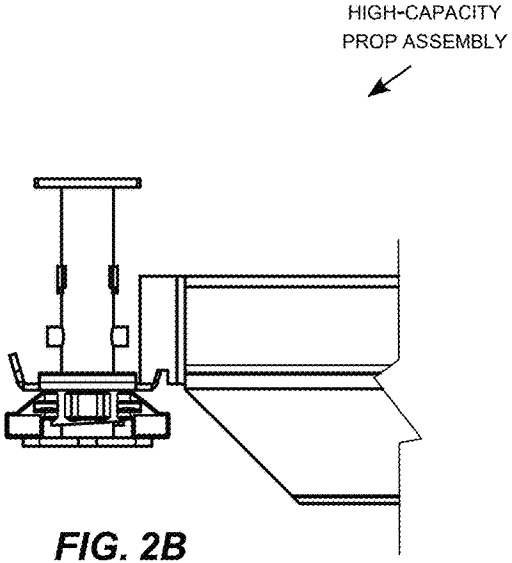
FIG. 2B is a front view the high-capacity prop assembly supporting the high-capacity beam in a lower position.
Figure 2A:
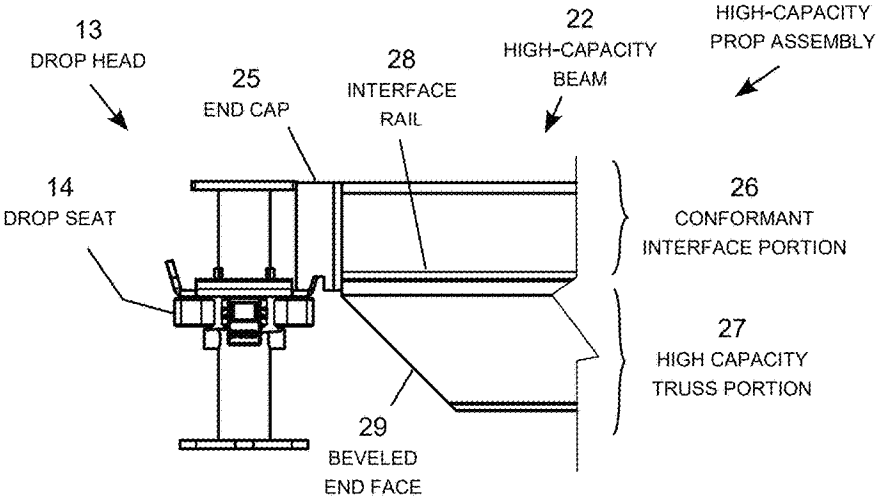
FIG. 2A is a front view a high-capacity prop assembly supporting a high-capacity beam in an upper position.

FIG. 2A is a front view a high-capacity prop assembly 20 utilizing the first type of drop head 13 supporting a high-capacity beam 22 in an upper position. The drop head 13 includes a drop seat 14 removably engaged with a conformant end cap 25 attached to the end of the high-capacity beam 22. Generally, the high-capacity beam 22 includes a conformant interface portion 26 and a high-capacity truss portion 27. The conformant interface portion 26 includes conformant interface rails on opposing sides of the beam represented by the enumerated conformant interface rail 88. Similar to the low-capacity beam 12, the conformant components of the high-capacity beam 22 are designed to removably engage with, and are therefore compatible with, the preexisting system of modular low-capacity beams, joists, drop heads, props, clips, prop positioners, etc.

FIG. 2A shows the drop seat 14 supporting the high-capacity beam 22 in an upper position where, for example, the high-capacity beam supports one or more concrete forms fabricate from plywood, sheet metal, plastic or other suitable material. The concrete forms, in turn, support a wet concrete structure, such as a concrete platform, while the concrete sets. As shown in FIG. 2B, once the concrete sets sufficiently, the drop seat 14 is lowered, for example by striking a movable component of the drop head with a hammer. This lowers the high-capacity beam 22, to facilitate removal of the concrete forms.

In the grid shoring industry, there are a variety of different drop heads with somewhat different configurations. For example, a first type of drop head utilizes a pin that is removed to lower the drop seat, a second type of drop head utilizes a rotating plate that rotated with a hammer strike to the to lower the drop seat, a third type of drop head utilizes a sliding plate that is moved laterally with a hammer strike to lower the drop seat. There are other types of drop heads in use in the industry. Embodiments of the high-capacity beams are interoperable with any type of the drop head that has a drop seat with a conformant beam interface to removably engage the conformant end cap on the high-capacity beam.

Figure 3:
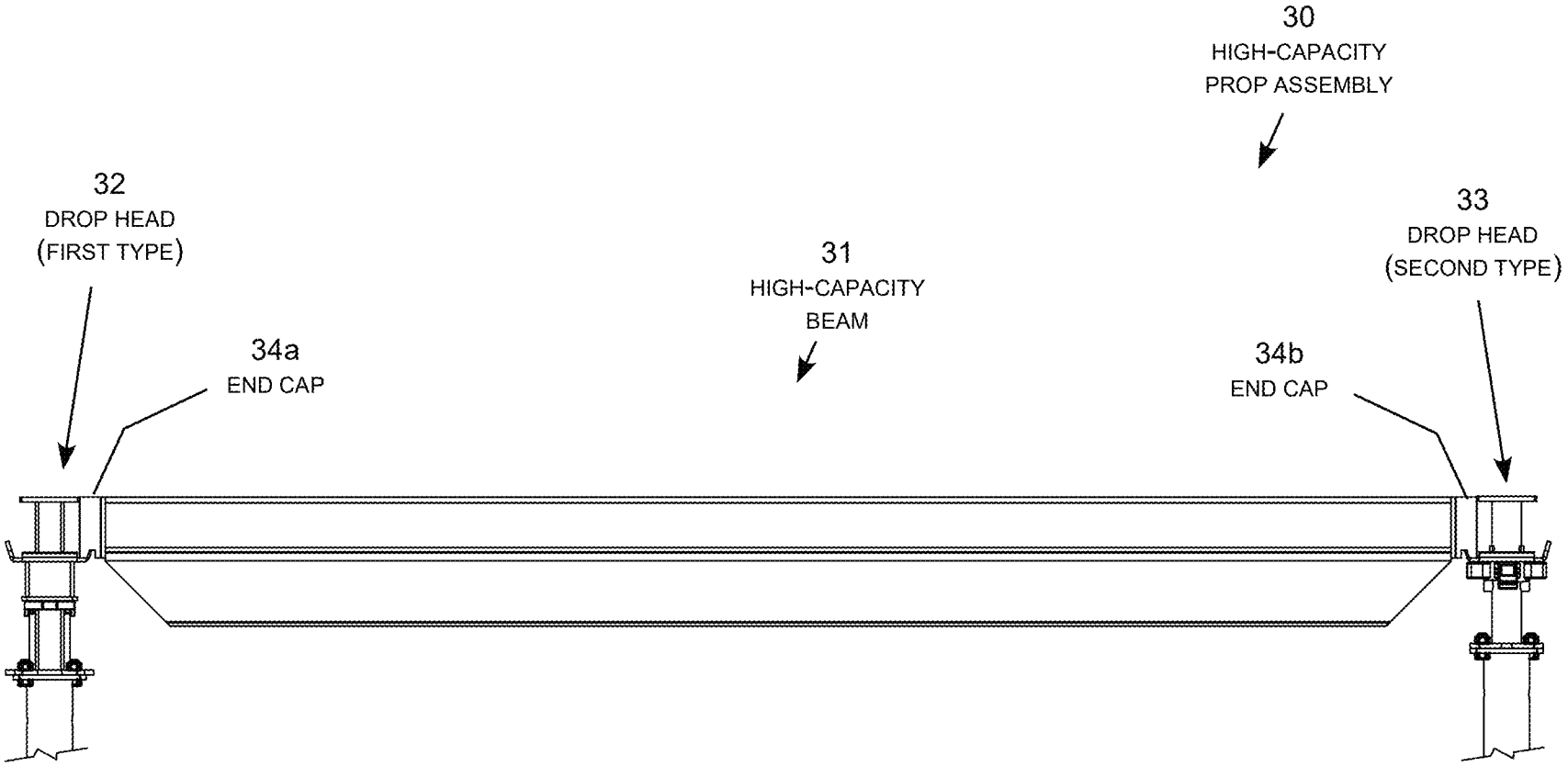
FIG. 3 is a side view a high-capacity prop assembly utilizing different types of drop heads.

To illustrate this type of drop head interoperability, FIG. 3 is a side view a high-capacity prop assembly 30 including a high-capacity beam 31 supported by different types of drop heads 32 and 33. The high-capacity beam 31 includes conformant end caps 34*a* and 34*b* on attached to respective opposing ends of the beam. The first conformant end cap 34*a* is removably engaged with the first type of drop head 32, while the second conformant end cap 34*b* is removably engaged with the second type of drop head 33. In general, as noted above, the drop heads 32 and 33 may be any type of drop head that has a drop seat with a conformant beam interface to removably engage the conformant end caps 34*a* and 34*b* on the high-capacity beam 31.

Figures 4A, 4B:
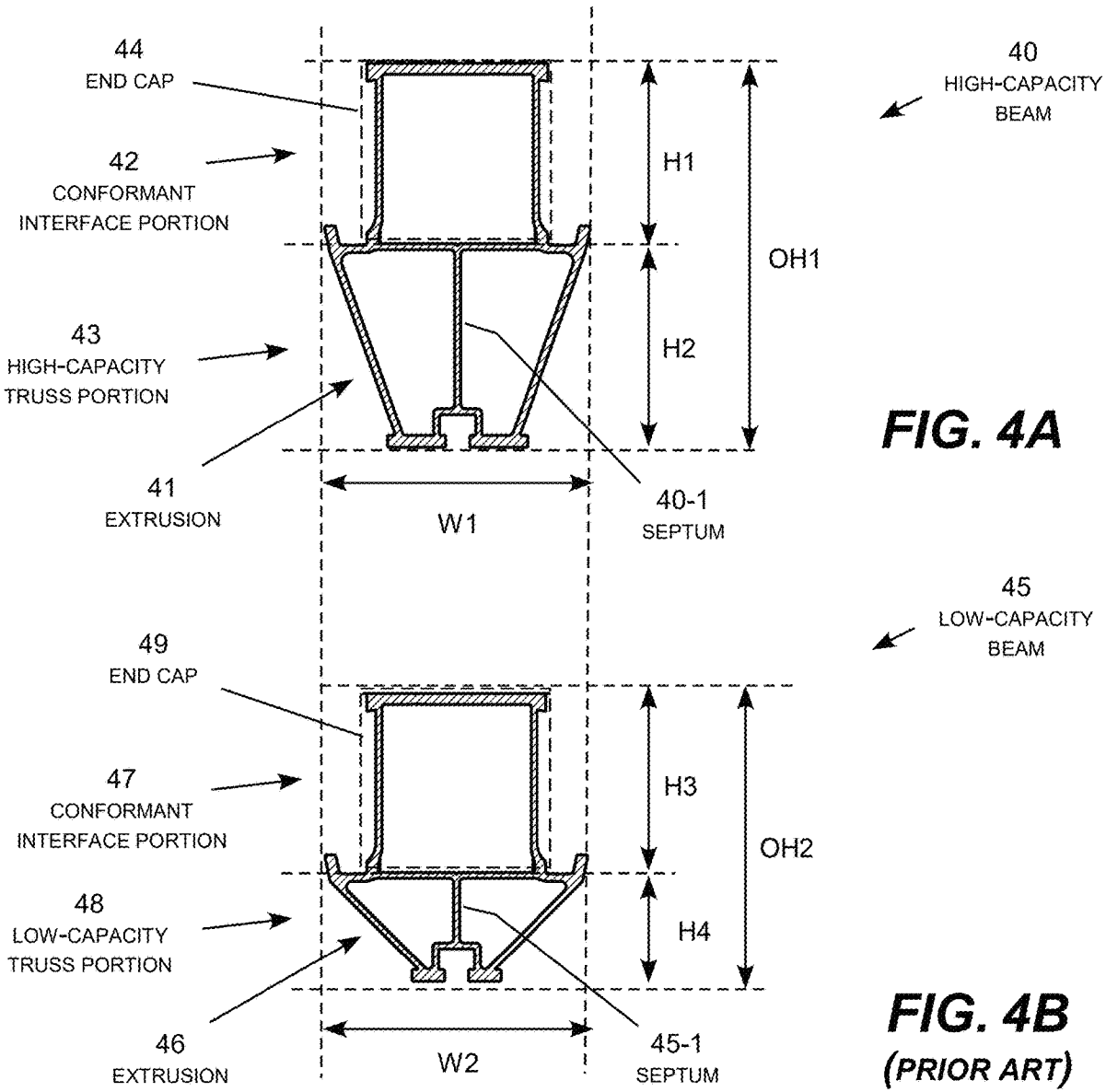
FIG. 4B (PRIOR ART)
FIGS. 4A and 4B show a comparison of cross-sectional views of a high-capacity beam and a low-capacity beam.

FIGS. 4A and 4B show a comparison of cross-sectional views of representative embodiments of a high-capacity beam 40 and a low-capacity beam 45. The high-capacity beam 40 is formed by an extrusion 41 elongated in a longitudinal direction defining a conformant interface portion 42 with a height H1 and a high capacity truss portion 43 with a height H2, resulting in an overall height OH1. An end cap 44, which is welded or bolted onto the conformant interface portion 42 substantially fills or covers the conformant the frontal end of the interface portion adding substantial strength to the high-capacity beam 40. In addition, a vertical septum 40-1 bisects the high-capacity truss portion 43 adding additional strength to the high-capacity beam 40.

The high-capacity beam 40 is formed by an extrusion 41 elongated in a longitudinal direction defining a conformant interface portion 42 with a height H1 and a high capacity truss portion 43 with a height H2, resulting in an overall height OH1 and a width W2. An end cap 44, which is welded or bolted onto the conformant interface portion 42 substantially fills or covers the conformant the frontal end of the interface portion adding substantial strength to the high-capacity beam 40. In addition, a vertical septum 40-1 bisects the high-capacity truss portion 43 adding additional strength to the high-capacity beam 40.

Similarly, the low-capacity beam 45 is formed by an extrusion 46 elongated in a longitudinal direction defining a conformant interface portion 47 with a height H3 and a high capacity truss portion 48 with a height H4, resulting in an overall height OH2 and a width W1. An end cap 49, which is welded or bolted onto the conformant interface portion 42 substantially fills or covers the conformant the frontal end of the interface portion adding substantial strength to the high-capacity beam 40. In addition, a vertical septum 40-1 bisects the high-capacity truss portion 43 adding additional strength to the high-capacity beam 40.

In a representative embodiment, the height H1 and width W1 of the conformant interface portion 42 of the high capacity beam 40 is substantially the same as the height H3 and width W2 of the conformant interface portion 47 of the low-capacity beam 45. However the height H4 of the conformant interface portion 42 of the high capacity beam 40 is substantially greater than the height H4 of the low-capacity beam 45. In a more specific representative embodiments illustrated by FIG. 4, the high-capacity beam 40 and the low-capacity beam 45 are shown substantially to scale, where the overall height OH1 of the high-capacity beam 40 is approximately 8.4 inches (21.3 cm), and the overall height OH2 of the low-capacity beam 45 is approximately 6.3 inches (e.g., 16.0 cm). The height H3 of the conformant interface portion 41 of the high-capacity beam 40 is 4.0 inches (10.1 cm). Likewise, height H3 of the conformant interface portion 46 of the low-capacity beam 40 is also 4.0 inches (10.1 cm).

Figure 5B:
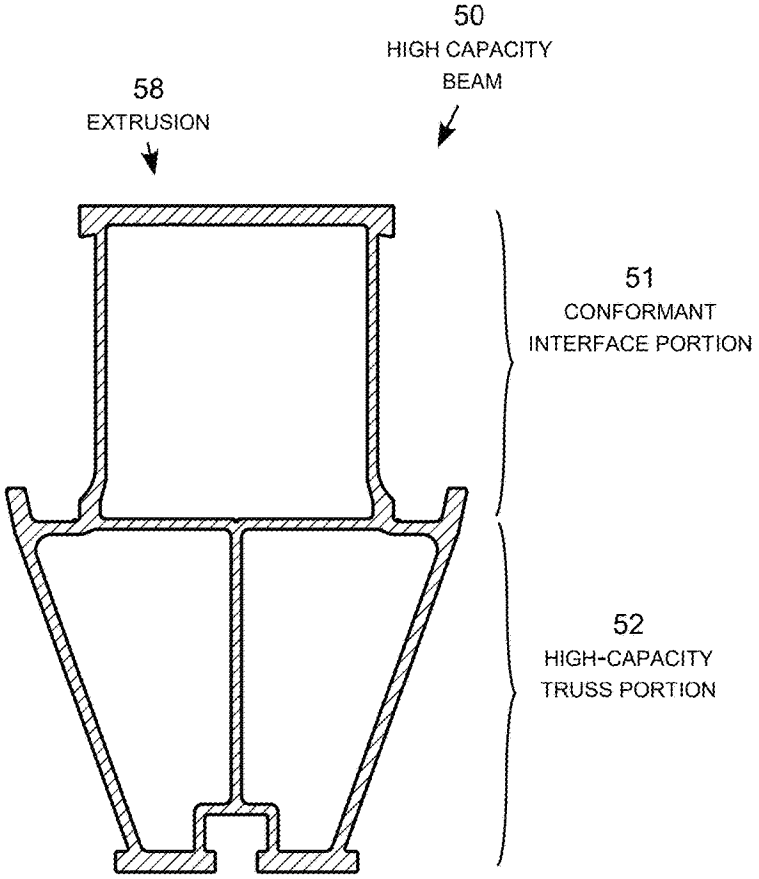
FIG. 5B is a cross-sectional view of the representative embodiment of the high-capacity beam.
Figure 5A:
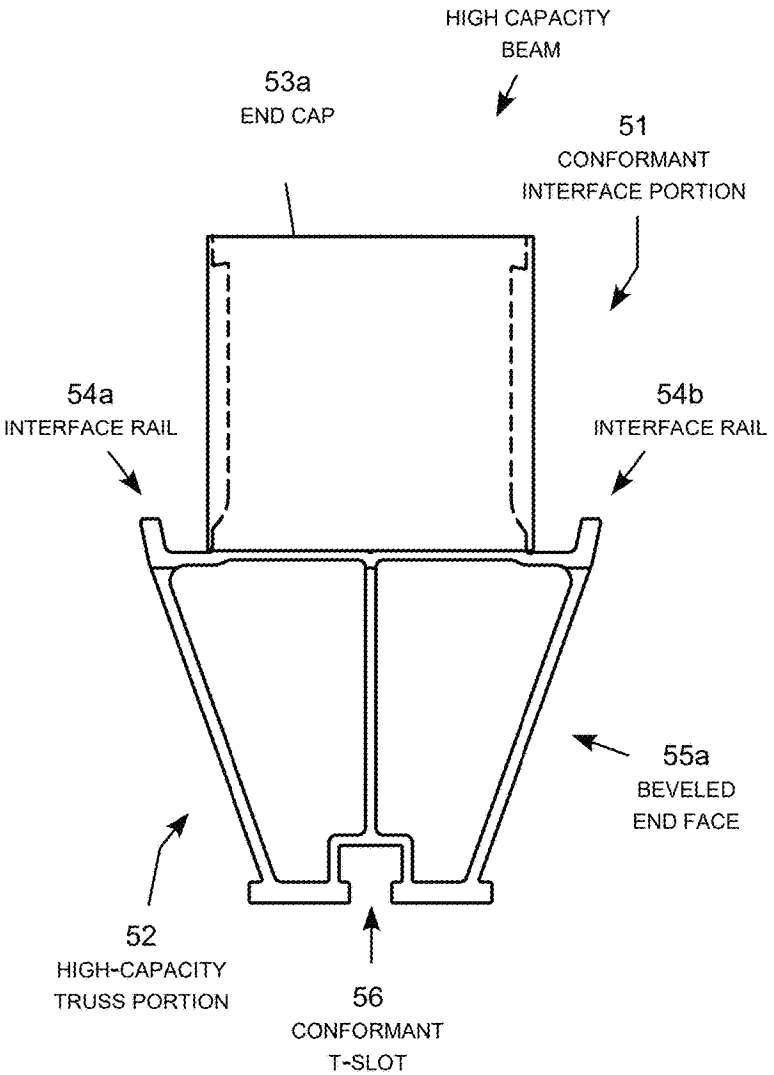
FIG. 5A is an end view of a representative embodiment of the high-capacity beam.

FIGS. 5A-5H show various views of a representative embodiment, high-capacity beam 50 with a nominal 8-foot length. FIG. 5A is an end view of the high-capacity beam 50 illustrating a conformant interface portion 51 and high-capacity truss portion 52 extending from a bottom side of the conformant interface portion. A conformant end cap 53*a* is attached to the illustrated end of the conformant interface portion 51 (there is another conformant end cap 53*b* attached to the opposing end of the conformant interface portion). The conformant interface portion 51 includes conformant interface rails 54*a* and 54*b* disposed on respective opposing sides of the conformant interface portion. The illustrated end of the high-capacity truss portion 52 defines a beveled end face 55*a* (there is another beveled end face 55*a* defined by the opposing end of the conformant interface portion). In addition, the bottom side of the high-capacity truss portion 52 includes a conformant T-slot 56 for removably receiving certain components of the modular grid shoring system, such as clips and prop positioners.

Figure 5D:
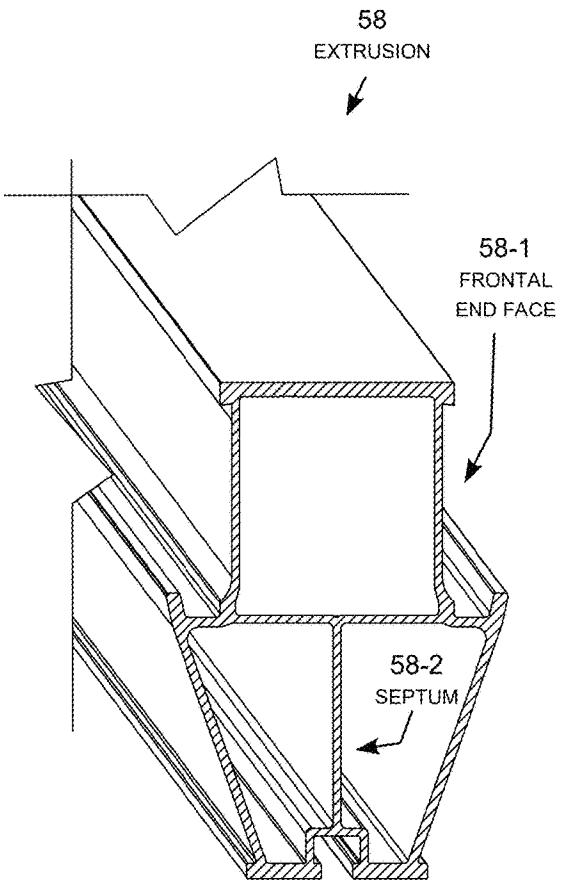
FIG. 5D is a perspective cross-sectional of a portion view of the representative embodiment of the high-capacity beam.
Figure 5C:
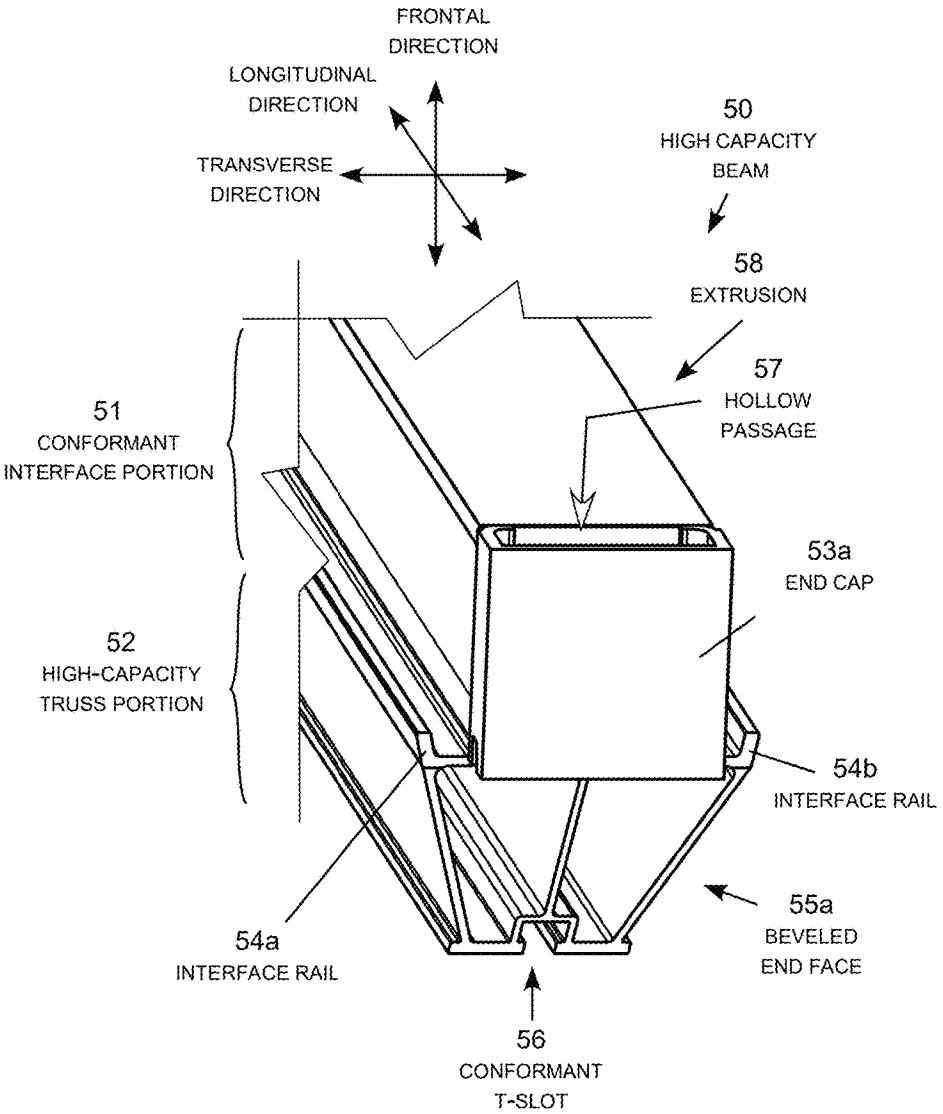
FIG. 5C is a perspective end view of a portion of the representative embodiment of the high-capacity beam.

FIG. 5B is a cross-sectional view of the high-capacity beam 50, which illustrates the same features as FIG. 5A excluding the conformant end cap 53*a* and the beveled end face 55*a* not visible in the cross-sectional view. FIG. 5C is a perspective end view of a portion of the high-capacity beam providing a perspective view of the same features shown in FIG. 5A. Similarly, FIG. 5D is a perspective cross-sectional of the high-capacity beam 50 providing a perspective view the same features shown in FIG. 5B.

FIG. 5C also illustrates a hollow passage 57 through the conformant end cap 53*a*, which is oriented vertically when the high-capacity beam 50 is oriented horizontally. The hollow passage 57 can be utilized to removably engage with other components of the modular grid showing system. See, for example, FIG. 9, which illustrates a handrail utilizing hollow passage 57 as a handrail mount.

Figure 5E:
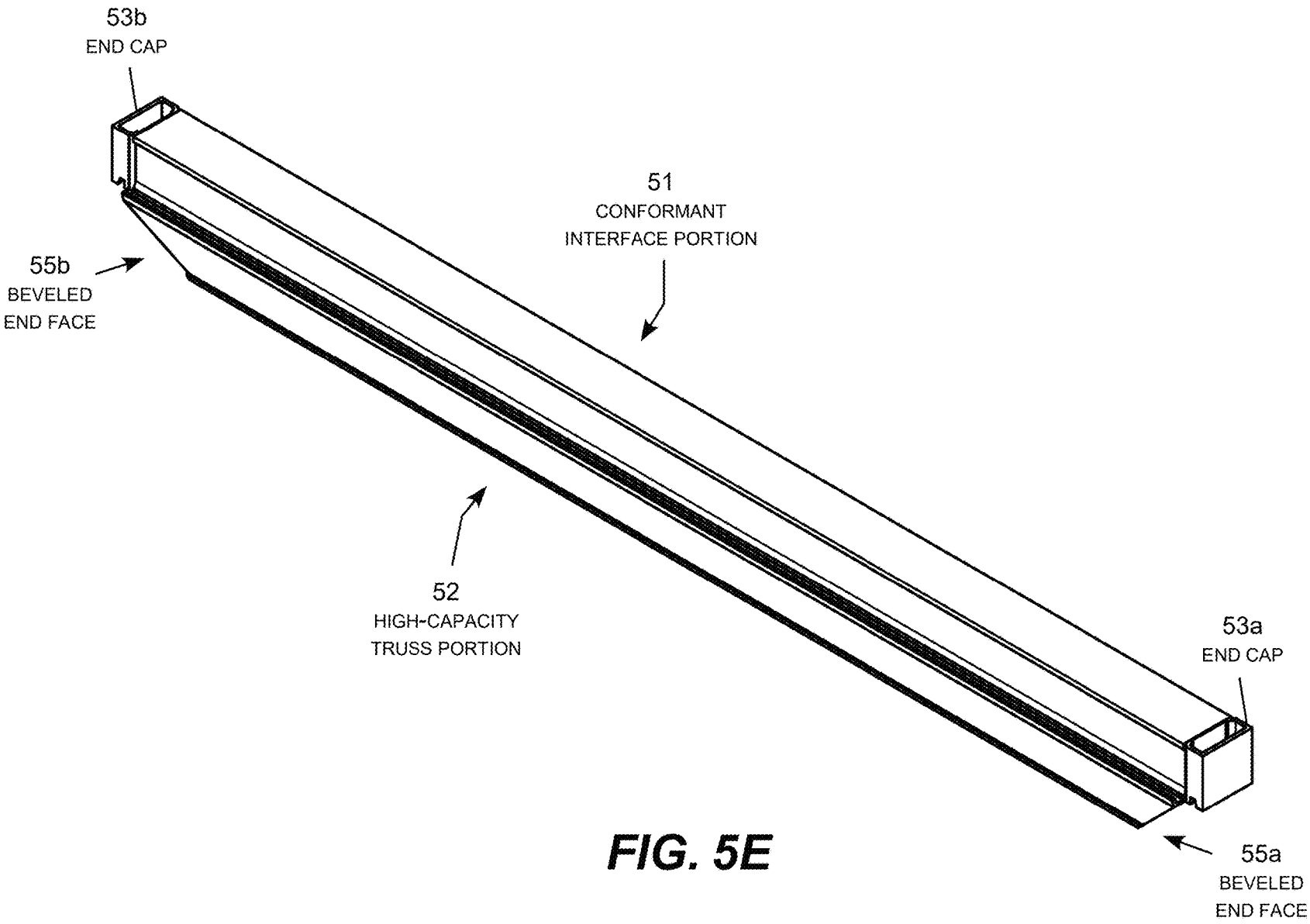
FIG. 5E is a perspective view of the representative embodiment of the high-capacity beam.

FIG. 5E is a perspective view of the full length of the high-capacity beam 50 illustrating conformant end caps 53*a* and 53*b* disposed on opposing respective ends of the conformant interface portion 51. FIG. 5E also illustrates the beveled end faces 55*a* and 55*b* disposed on opposing respective ends of the high-capacity trust portion 52.

Figure 5F:
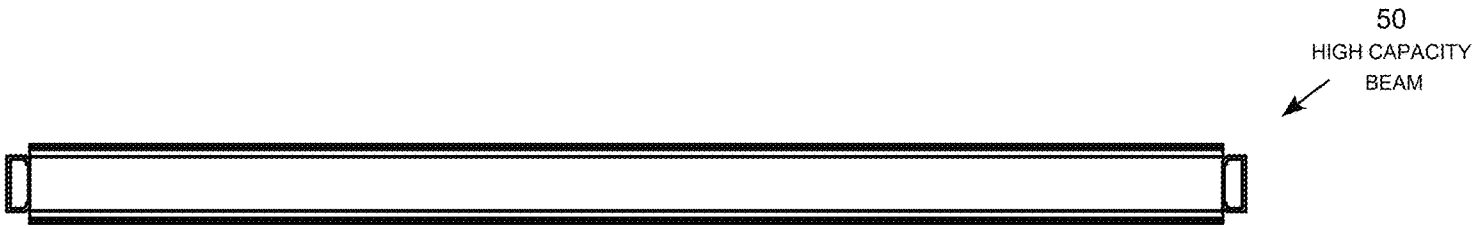
FIG. 5F is a top view of the representative embodiment of the high-capacity beam.
Figure 5G:
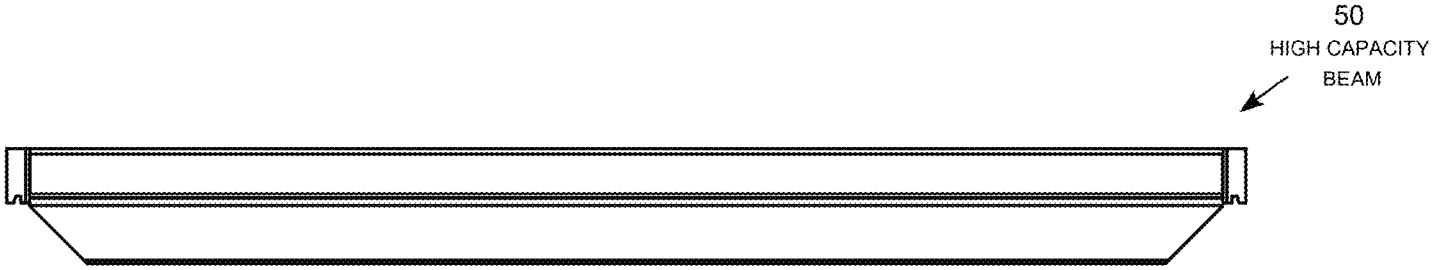
FIG. 5G is a side view of the representative embodiment of the high-capacity beam.
Figure 5H:
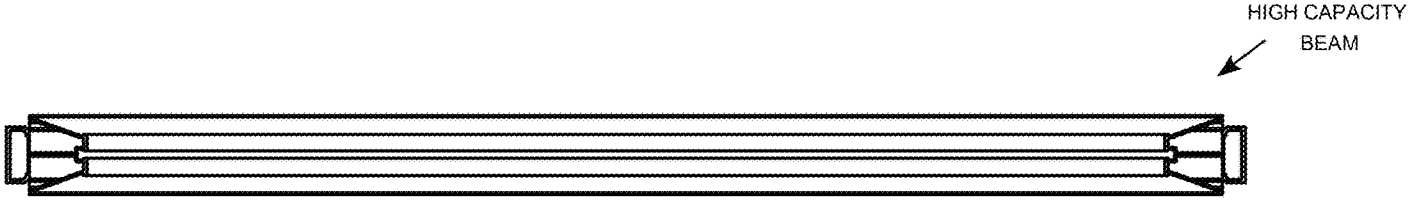
FIG. 5H is a bottom view of the representative embodiment of the high-capacity beam.

FIG. 5F is a top view of the high-capacity beam 50, FIG. 5G is a side view of the high-capacity beam, and FIG. 5H is a bottom view of the high-capacity beam 50 illustrating the same features from additional vantage points.

Figure 6A:
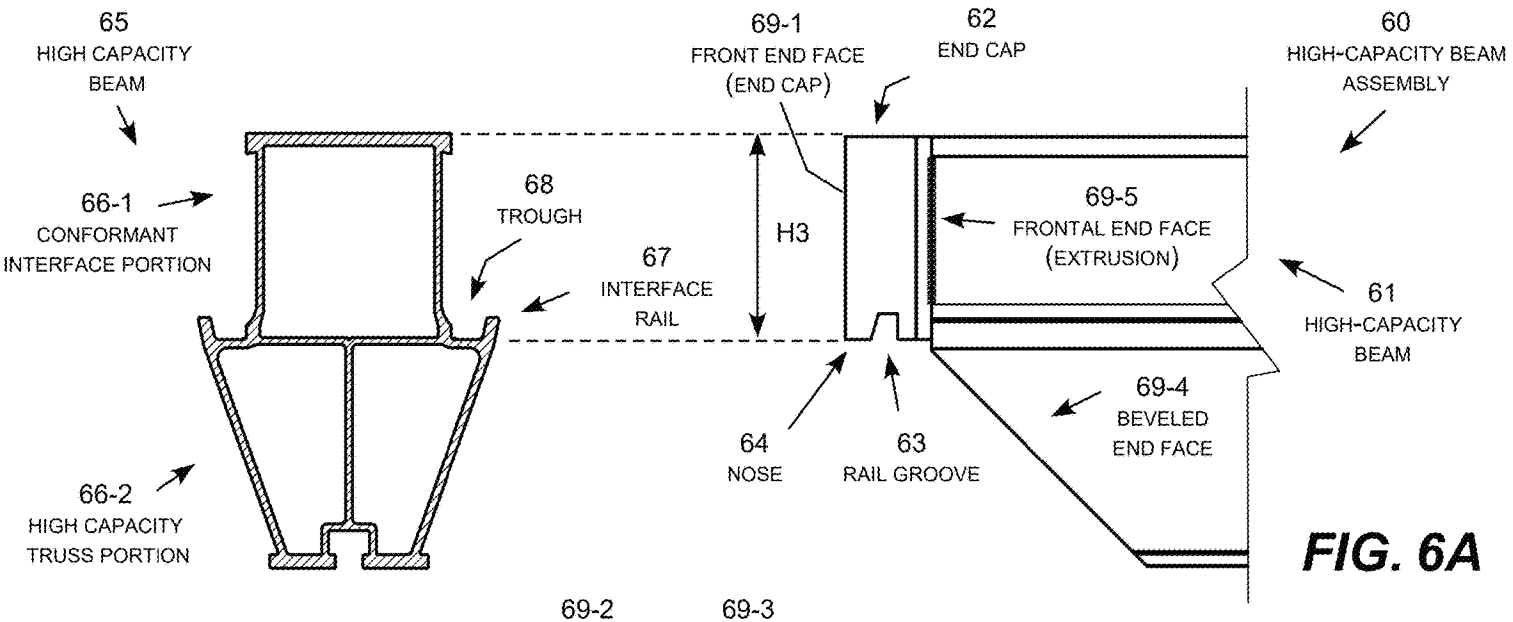
FIG. 6A is an exploded view of a high-capacity beam assembly.
Figure 6B:
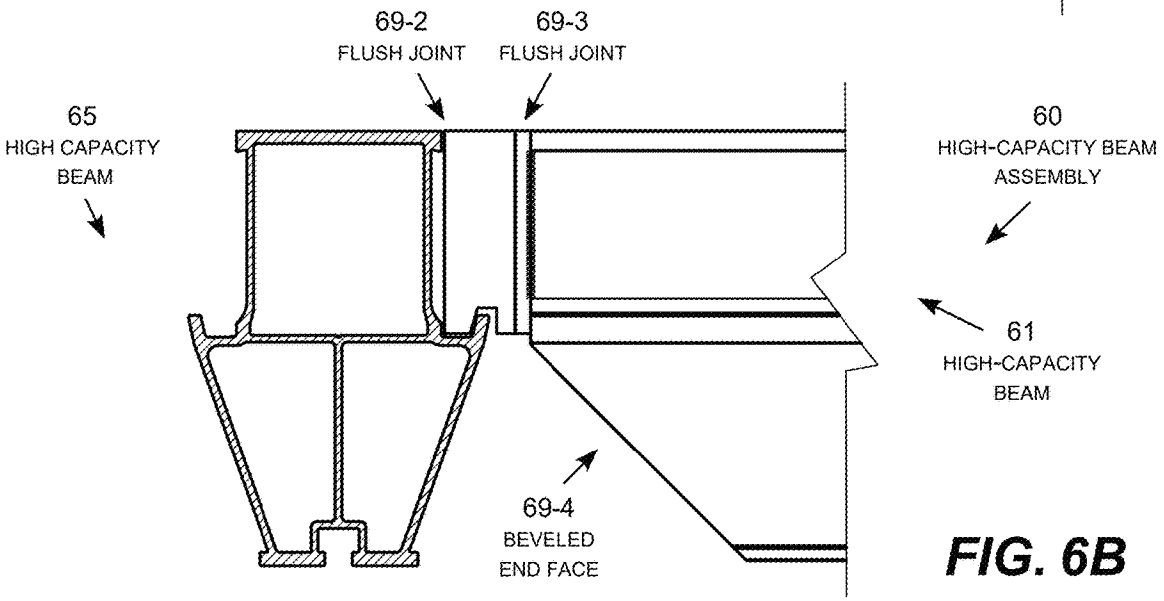
FIG. 6B is an assembled view of a high-capacity beam assembly.

FIG. 6A is an exploded view of a high-capacity beam assembly 60, and FIG. 6B is an assembled view the high-capacity beam assembly. The assembly includes a high-capacity beam 61 with a conformant end cap 62 and height H3. The conformant end cap 62 has a conformant rail groove 63 which forms a conformant nose 64. In addition, the high-capacity beam 65 includes a conformant interface portion 66. The conformant interface portion 66 includes a conformant interface rail 67 forming a conformant trough 68. As shown in FIG. 6B, the conformant nose 64 of the conformant end cap 62 fits into the conformant trough 68 of the high-capacity beam 65 when the conformant rail groove 63 is positioned on the conformant interface rail 67. The conformant end cap 62 and the conformant interface portion 66 of the high-capacity beam 65 both have height H3 (see also FIGS. 4A-4B), which causes the top of the conformant end cap 62 to be flush with the top of the high-capacity beam 65 when assembled as shown in FIG. 6B. The high-capacity beam 61 is thus conformant and interoperable with the high-capacity beam 65.

The left portion of FIG. 6A shows a cross-section of the high-capacity beam 65 identifying the conformant interface portion 66-1, high-capacity truss portion 66-2, interface rail 67, and trough 68. The right portion of FIG. 6A shows a side view of an end portion of the high-capacity beam 61 including an end cap 62 extending from a frontal end face (extrusion) 69-5 having a height H3. The end cap 62 includes a frontal end face (end cap) 69-1, having a height H3, groove 63 and nose 64. The high-capacity beam 61 also includes a beveled end face 69-4. The assembled view FIG. 6B shows the groove 63 of the high-capacity beam 61 received on the interface rail 67 of the high-capacity beam 65. The nose 64 of the high-capacity beam 61 is received in the trough 68 of the interface rail 67 of the high-capacity beam 65. The top of the end cap 62 forms a flush joint 69-2 with the top of the high-capacity beam 65, as well as a flush joint 69-3 with the top of the high-capacity beam 61.

Figure 6C:
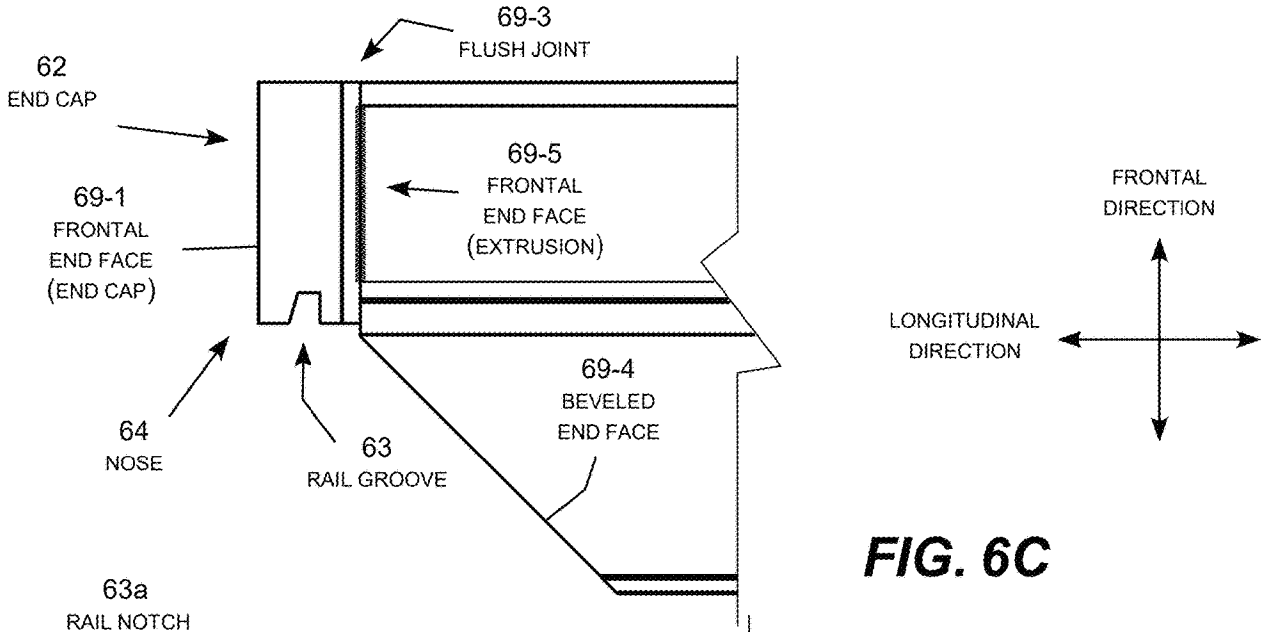
FIG. 6C is a side view of an end portion of the high-capacity beam.
Figure 6D:
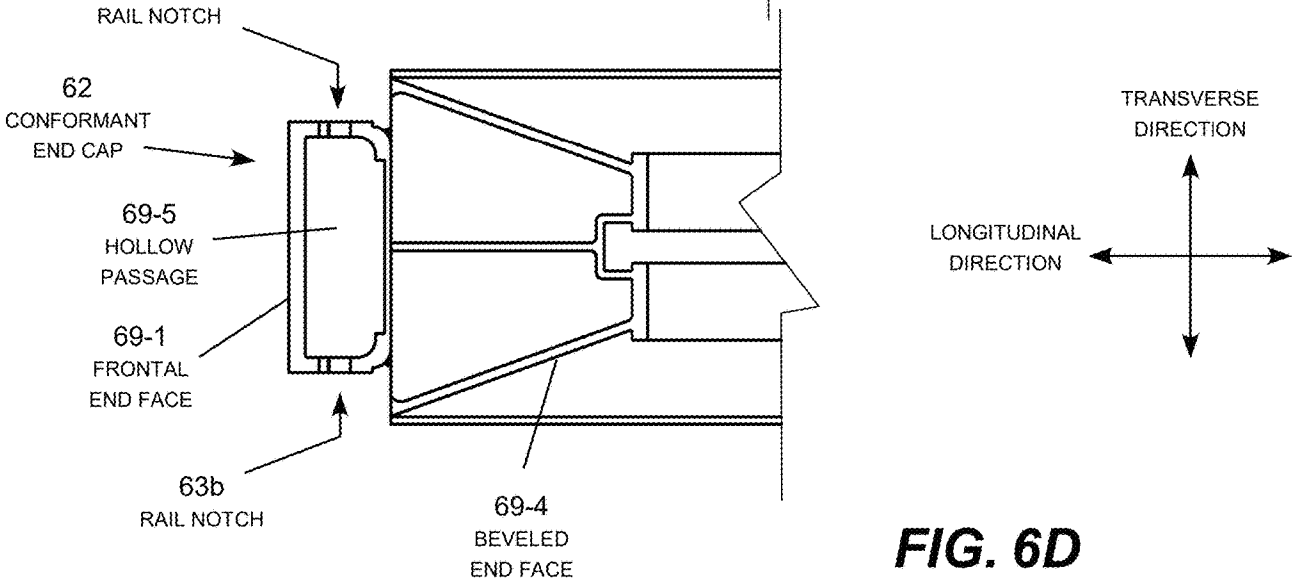
FIG. 6D is a bottom view of an end portion of the high-capacity beam.

FIG. 6C is a side view of the end portion of the high-capacity beam, which is also shown in the right portion of FIG. 6A. FIG. 6D is a bottom view of this portion of the high-capacity beam showing rail notches 63*a* and 63*b* forming the groove 63 shown in FIG. 6C. FIG. 6D also shows the frontal end face 69-1 and hollow passage 69-5 of the end cap 62. These figures identify the longitudinal direction and frontal direction for reference.

FIGS. 6A-6D illustrate the interoperable features that allow a conformant end cap to assemble with a conformant interface portion of a beam. A variety of different conformant end caps may therefore be designed, provided that they include the interoperable features of the modular beams. In the representative embodiment shown in FIGS. 6A-6D, the interoperable features include the conformant rail groove 63 and a conformant nose 64 designed for interoperability with the conformant rail interface 67 and the conformant trough 68. Although the representative embodiments include these specific interoperable features, modular grids shoring systems with other interoperative features may be utilized. The innovative high-capacity beam is not dependent upon the specific interoperable features employed for interoperability with a specific modular grids shoring system.

Figure 7:
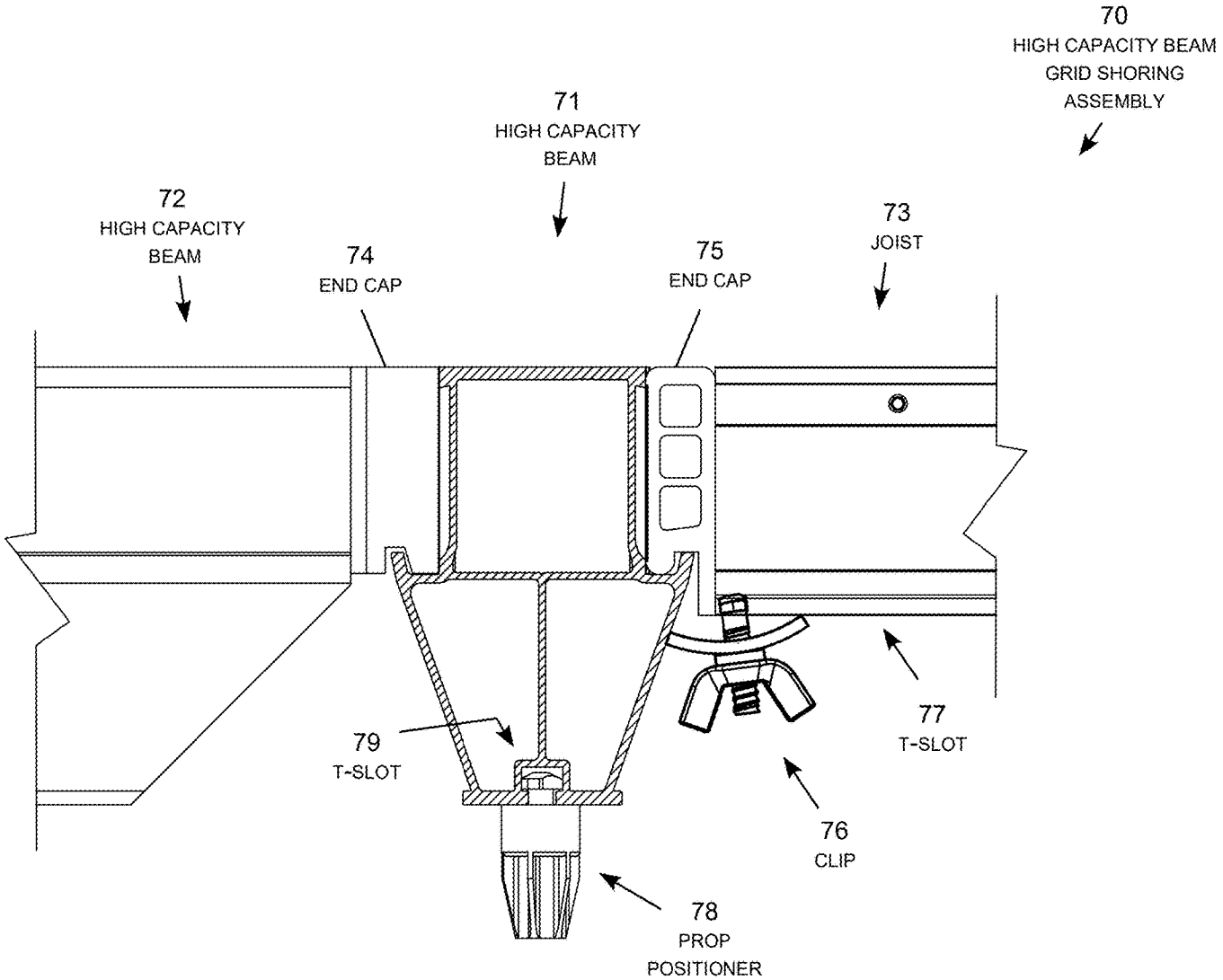
FIG. 7 is an assembled view of a high-capacity beam grid shoring assembly.

FIG. 7 is an assembled view of a high-capacity beam grid shoring assembly 70 including a high-capacity beam 71 supporting another high-capacity beam 72 on one side (i.e., received on a first interface rail), and joist 73 on the other side (i.e., received on the opposing interface rail). The high-capacity beam 72 includes a first type of conformant end cap 74, as described above with reference to FIGS. 6A and 6B. The joist 73, on the other hand, includes a different type of end cap 75. While the end caps 74 and 75 are different in some respects, they are both conformant end caps interoperable with the high-capacity beam 71. Other types of conformant end caps may be designed with different features for other types of applications.

FIG. 7 also illustrates certain other interoperable components of the modular grid shoring system. Specifically, the joist 73 includes a clip 76 removably received in a conformant T-slot on the bottom side of the joist. The clip 76 is tightened against the high-capacity truss portion of the high-capacity beam 71 to prevent the joist 73 from lifting out of engagement with the high-capacity beam. This is useful, for example, to prevent a cantilevered joist from tipping out of engagement with the high-capacity beam 71. This particular example also includes a prop positioner 78 removably received in a conformant T-slot 79 of the high-capacity beam 71. The prop positioner 78 is useful to guide the high-capacity beam 71 into engagement with a prop with a hole designed to receive the prop positioner.

Figure 8:
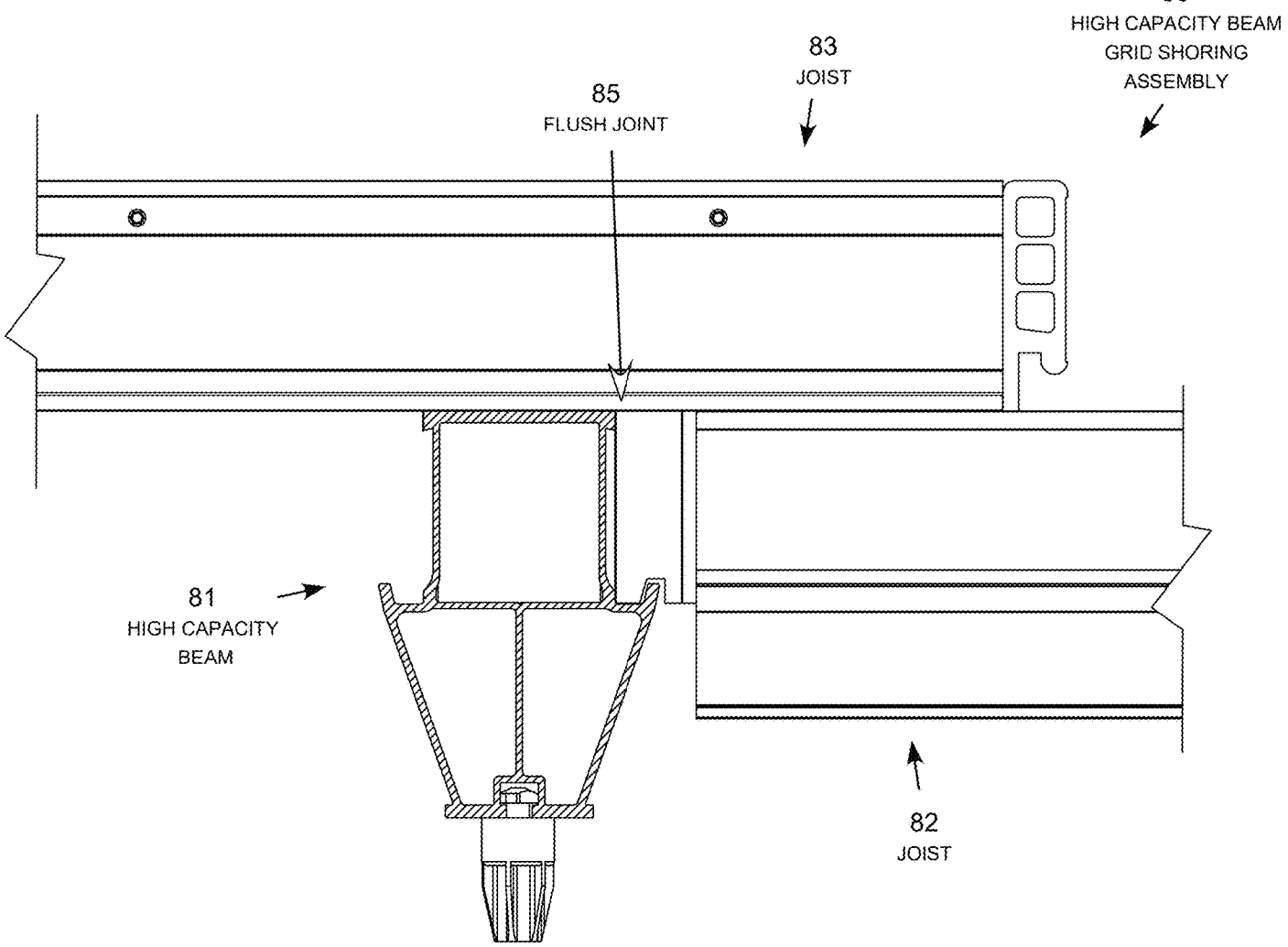
FIG. 8 is an assembled view of an alternative high-capacity beam grid shoring assembly.

FIG. 8 is an assembled view of an alternative high-capacity beam grid shoring assembly 80. This example includes a high-capacity beam 81 supporting a first joist 82. A second joist 83 is positioned across the tops of the high-capacity beam 81 supporting a first joist 82. This configuration is facilitated by the flush joint 85 formed between the high-capacity beam 81 first joist 82. Similar flush joints facilitate the temporary installation of concrete forms and other structures supported by the modular grad shoring system.

Figure 9:
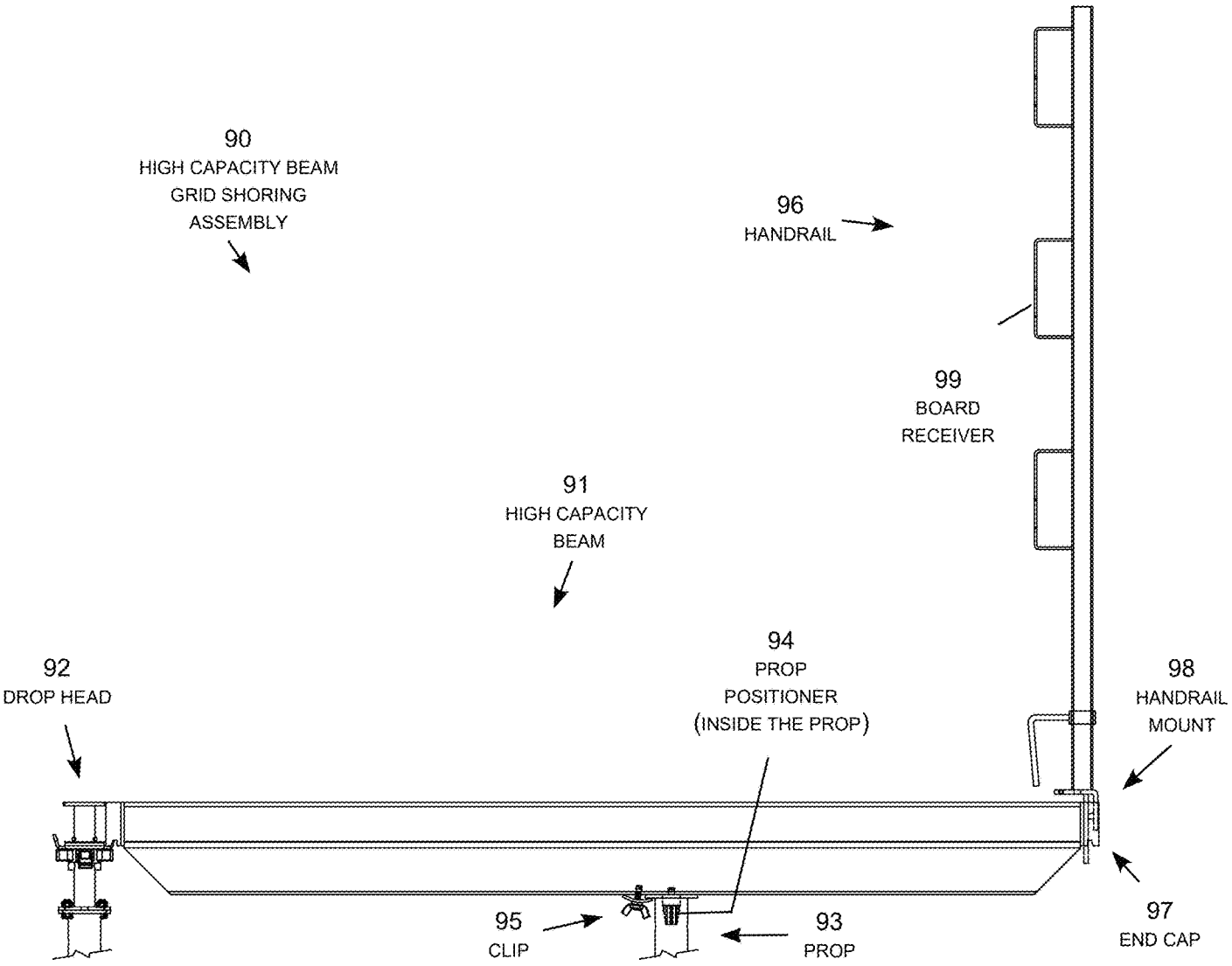
FIG. 9 is an assembled view of another alternative high-capacity beam grid shoring assembly.

FIG. 9 is an assembled view of another alternative high-capacity beam grid shoring assembly 90. This example includes a cantilevered end beam of the grid shoring assembly 90. More specifically, a high-capacity beam 91 is supported on one end by a drop head 92 and by a prop 93 at an intermediate location before the opposing end of the beam, leaving an end section of the high-capacity beam cantilevered beyond the prop. The prop 93 is assembled with the high-capacity beam 91 by a prop positioner 94 and a clip 95. The illustrated prop positioner 94 is located inside the prop 93, but shown in solid lines for clarity in the illustration. The clip 95 is removably received in a conformant T-slot on the bottom of the high-capacity beam 91 to secure the prop 93 to the high-capacity beam. The clip 95 thus prevents the cantilevered high-capacity beam 91 from tipping out of engagement with the drop head 92 as a result of a heavy weight or other force applied to the cantilevered portion of the high-capacity beam.

The example shown in FIG. 9 also includes a handrail 96 removably attached to a conformant end cap 97 attached to the cantilevered end of the high-capacity beam 91. Referring also to FIG. 5C, the hollow passage 57 of the conformant end cap 97 forms a handrail mount 98 for securing the handrail 96 to the high-capacity beam 91. The handrail 96 includes several board receivers represented by the enumerated board receiver 99. The board receiver 99 may be sized, example, to receive a standard "2-by-4" board. Multiple handrails supported by multiple high-capacity beams at the edge of a structure under construction, supporting multiple standard boards, may be used to fabricate a temporary safety barrier at the edge of the structure under construction.

Figure 10:
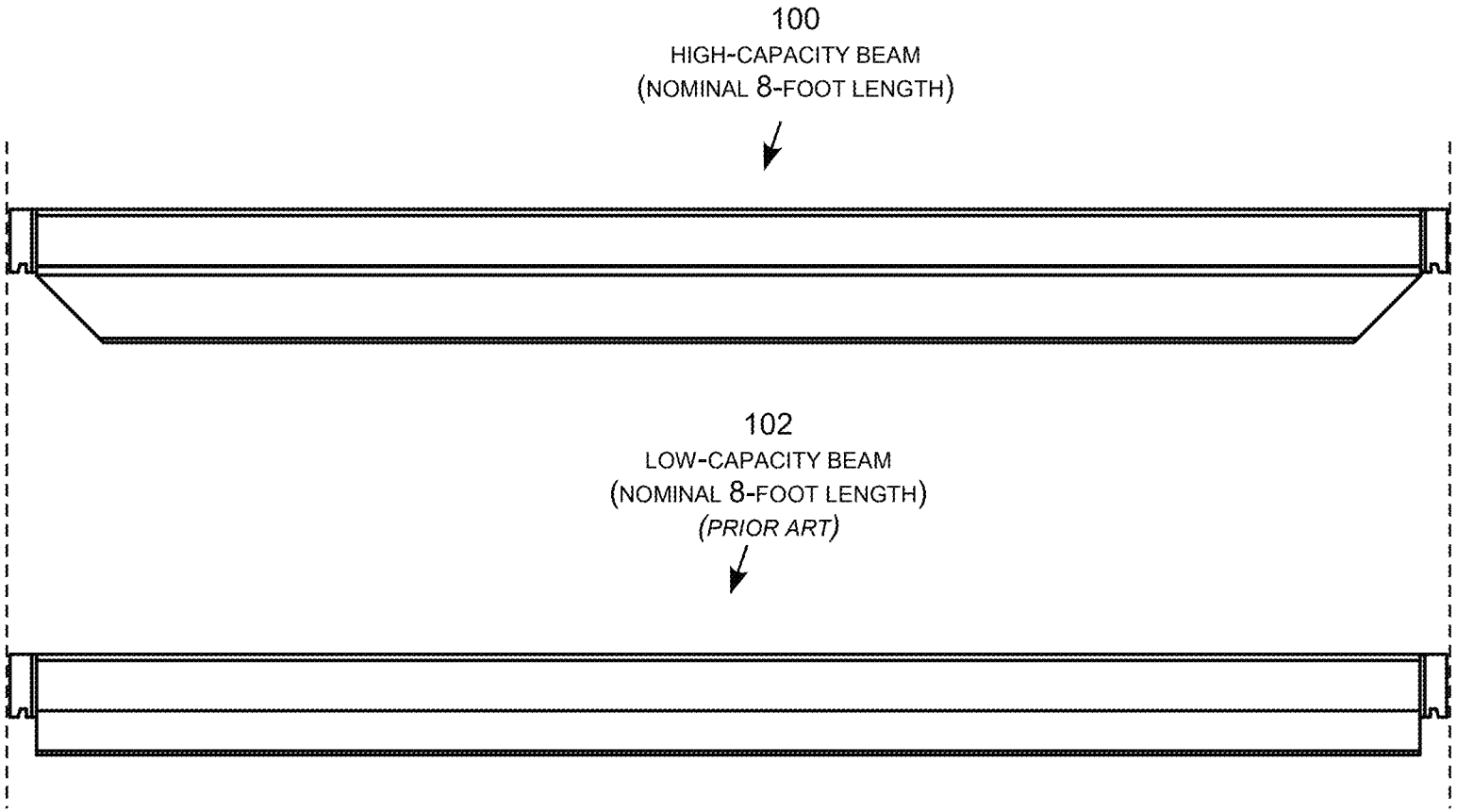
FIG. 10 shows a comparison between a nominal 8-foot length of a high-capacity beam and a nominal 8-foot length of a low-capacity beam.

FIG. 10 shows a comparison between a nominal 8-foot length of a high-capacity beam 100 and a nominal 8-foot length of a low-capacity beam 102. The nominal 8-foot high-capacity beam 100 is only about 25% heavier than the nominal 8-foot low-capacity beam 102, while exhibiting about double the load-carrying capacity. More specifically, the nominal 8-foot length of the low-capacity beam 102 weights less than about 40 lbs., while the nominal 8-foot length of the high-capacity beam 100 weighs less than about 50 lbs. In other words, the nominal 8-foot high-capacity beam 100 is about 25% heavier than the nominal 8-foot low-capacity beam 102. Nevertheless, a grid shoring assembly utilizing the low-capacity beam 102 is rated for supporting a nominal 6-inch concrete platform, while a grid shoring assembly utilizing the high-capacity beam 100 is rated for supporting a nominal 13-inch concrete platform. In other words, the high-capacity beam 100 exhibits about double the load-carrying capacity of the low-capacity beam 102. The innovative high-capacity beam thus produces significant improvements in the modular grid shoring system while maintaining backward compatibility with the interoperable components of the preexisting modular grid shoring system.

Figures 11, 12:
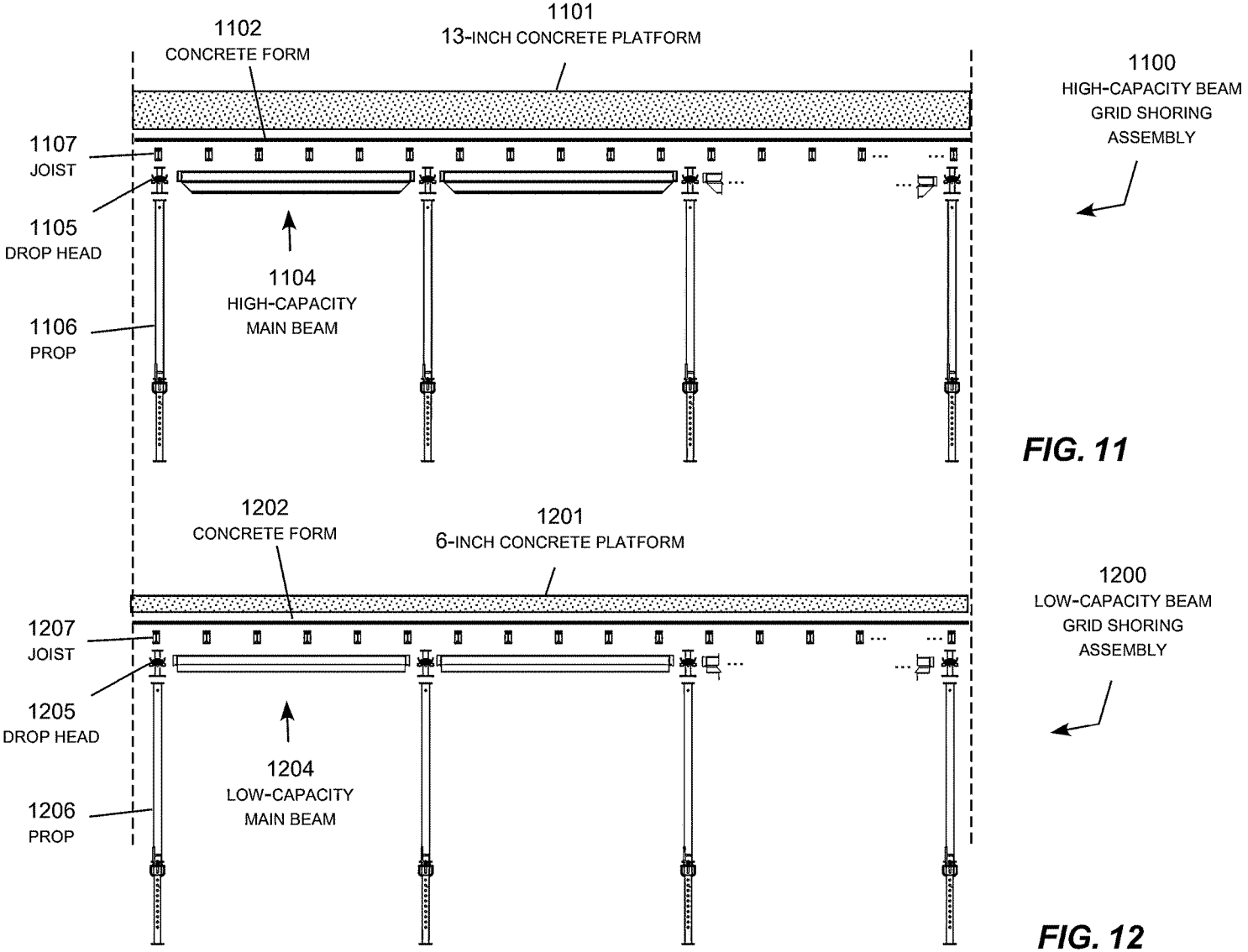
FIG. 12 (PRIOR ART)
FIG. 11 is an elevational exploded view of a high-capacity beam grid shoring assembly.
FIG. 12 is an elevational exploded view of a low-capacity beam grid shoring assembly.

To further illustrate this innovation, FIGS. 11 and 12 show a comparison between an exploded elevational view of a high-capacity beam grid shoring assembly 1100 shown in FIG. 11 and an exploded elevational view of a low-capacity beam grid shoring assembly 1200 shown in FIG. 12. Referring to FIG. 11, the high-capacity beam grid shoring assembly 1100 is rated to support a nominal 13-inch concrete platform 1101, with no more than a quarter-inch vertical deflection, while wet concrete forming the platform sets. It will be understood that the wet concrete is also supported by concrete forms, represented by the illustrated concrete form 1102, typically fabricated from plywood or another suitable material. The high-capacity beam grid shoring assembly 1100 includes a number of high-capacity main beams represented by the enumerated high-capacity main beam 1104. The high-capacity main beams are supported by dropheads represented by the enumerated drop head 1105. The drop heads, in turn, are supported by props represented by the enumerated prop 1106. A number of transverse joists represented by the enumerated joist 1107 extend between and are supported by the drop heads and the high-capacity beams. That is, some joists extend between and are supported by drop heads, while other joints extend between and are supported by the high-capacity main beams.

FIG. 12 shows an exploded elevational view of a low-capacity beam grid shoring assembly 1200 rated to support a nominal 6-inch concrete platform 12011, with no more than a quarter-inch vertical deflection, while wet concrete forming the platform sets. It will be understood that the wet concrete is also supported by concrete forms, represented by the illustrated concrete form 1202, typically fabricated from plywood or another suitable material. The low-capacity beam grid shoring assembly 1200 includes a number of low-capacity main beams represented by the enumerated low-capacity main beam 1204. The low-capacity main beams are supported by dropheads represented by the enumerated drop head 1205. The drop heads, in turn, are supported by props represented by the enumerated prop 1206. A number of transverse joists represented by the enumerated joist 1207 extend between and are supported by the drop heads and the high-capacity beams. That is, some joists extend between and are supported by drop heads, while other joints extend between and are supported by the high-capacity main beams.

The comparison between FIGS. 11 and 12 shows that the high-capacity beam grid shoring assembly 1100 is rated to support a nominal 13-inch concrete platform 1101, while the low-capacity beam grid shoring assembly 1200 is rated to support a nominal 6-inch concrete platform 1101. In other words, the load-carrying capacity of the high-capacity beam grid shoring assembly 1100 is about double that of the low-capacity beam grid shoring assembly 1200. This increase in load-carrying capability is accomplished with a high-capacity beam 1104 that is only about 25% heavier than the low-capacity beam 1204. More specifically, the nominal 8-foot length of the high-capacity beam 1104 weighs less than about 50 lbs., and the nominal 8-foot length of the low-capacity beam 1204 weighs less than about 40 lbs.

Figure 13:
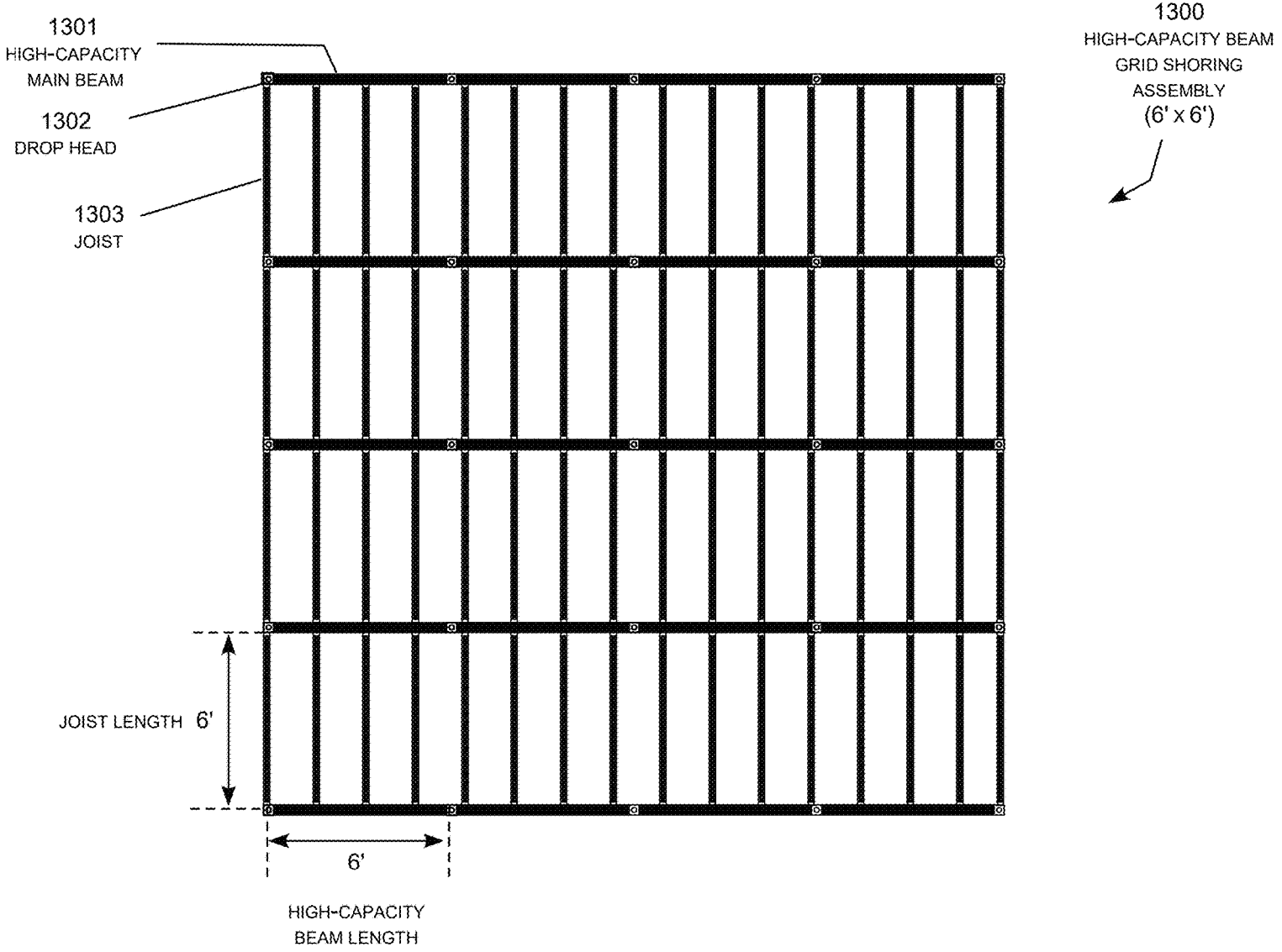
FIG. 13 shows a plan view of a first high-capacity beam grid shoring assembly.

FIG. 13 shows a plan view of a high-capacity beam grid shoring assembly 1300 utilizing nominal 6-foot high-capacity main beams and nominal 6-foot transverse joists referred to as a nominal "6-foot by 6-foot" grid shoring assembly. More specifically, the 6-foot by 6-foot grid shoring assembly includes 20 nominal 6-foot high-capacity main beams represented by the enumerated high-capacity main beam 1301. The high-capacity main beams are supported by 25 drop heads represented by the enumerated drop head 1302. The drop heads, in turn, are supported by props not shown in this figure. The high-capacity beam grid shoring assembly 1300 also includes 64 nominal 6-foot joists, represented by the enumerated joist 1303, extending transverse between the high-capacity main beams or drop heads. The high-capacity main beams, joists, drop heads and props are interoperable components of the modular grid-shoring system described previously. The 6-foot by 6-foot grid shoring assembly 1300 is rated to support a nominal 13-inch concrete platform with a maximum quarter-inch vertical deflection.

Figure 14:
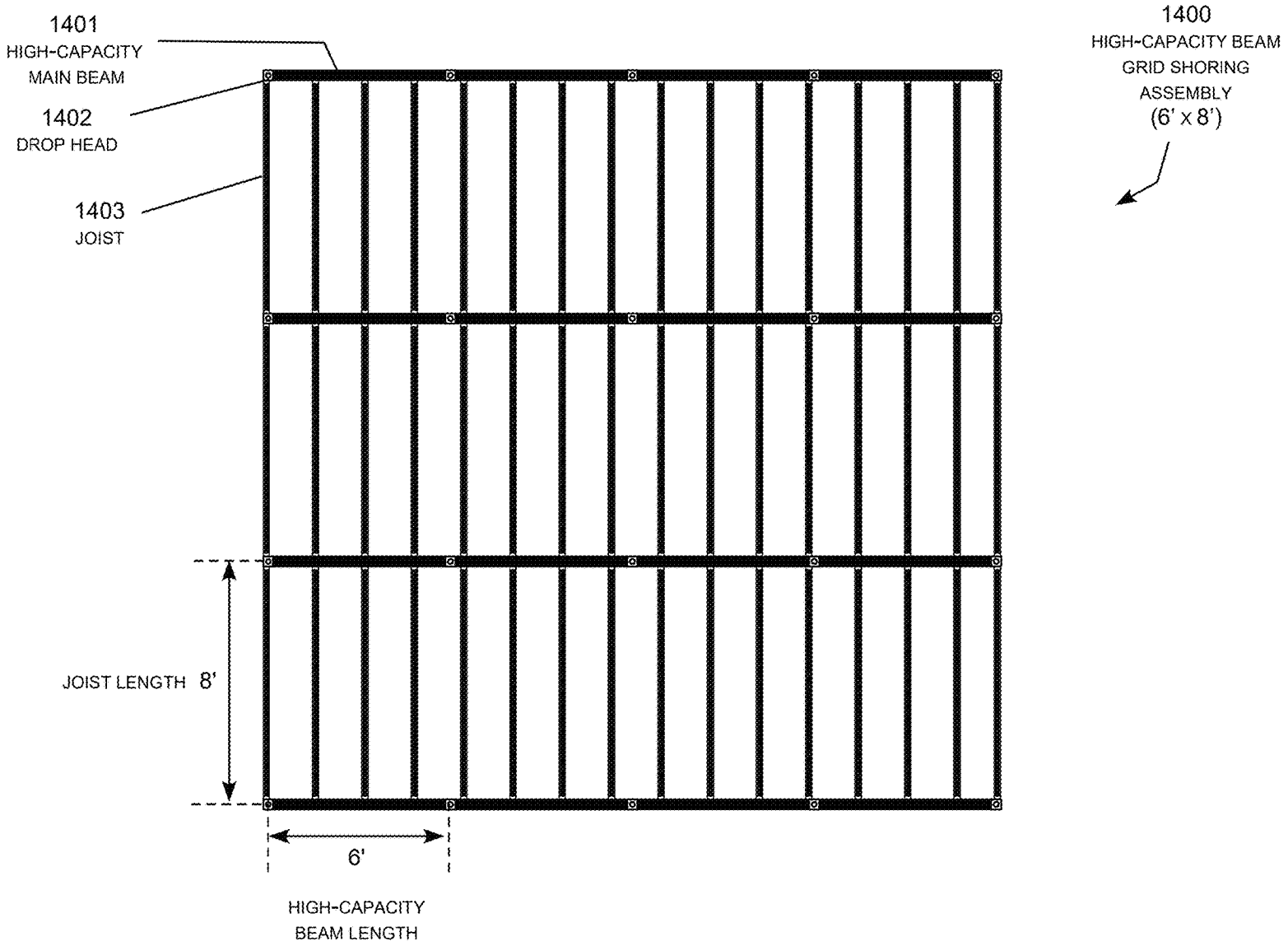
FIG. 14 shows a plan view of a second high-capacity beam grid shoring assembly.

FIG. 14 shows a plan view of a high-capacity beam grid shoring assembly 1400 utilizing nominal 6-foot high-capacity main beams and nominal 8-foot transverse joists referred to as a nominal "6-foot by 8-foot" grid shoring assembly. More specifically, the 6-foot by 8-foot grid shoring assembly includes 20 nominal 6-foot high-capacity main beams represented by the enumerated high-capacity main beam 1401. The high-capacity main beams are supported by 25 drop heads represented by the enumerated drop head 1402. The drop heads, in turn, are supported by props not shown in this figure. The high-capacity beam grid shoring assembly 1400 also includes 48 nominal 8-foot joists, represented by the enumerated joist 1403, extending transverse between the high-capacity beams or drop heads. The high-capacity beams, joists, drop heads and props are interoperable components of the modular grid-shoring system described previously. The 6-foot by 8-foot grid shoring assembly 1400 is rated to support a nominal 13-inch concrete platform with a maximum quarter-inch vertical deflection.

Figure 15:
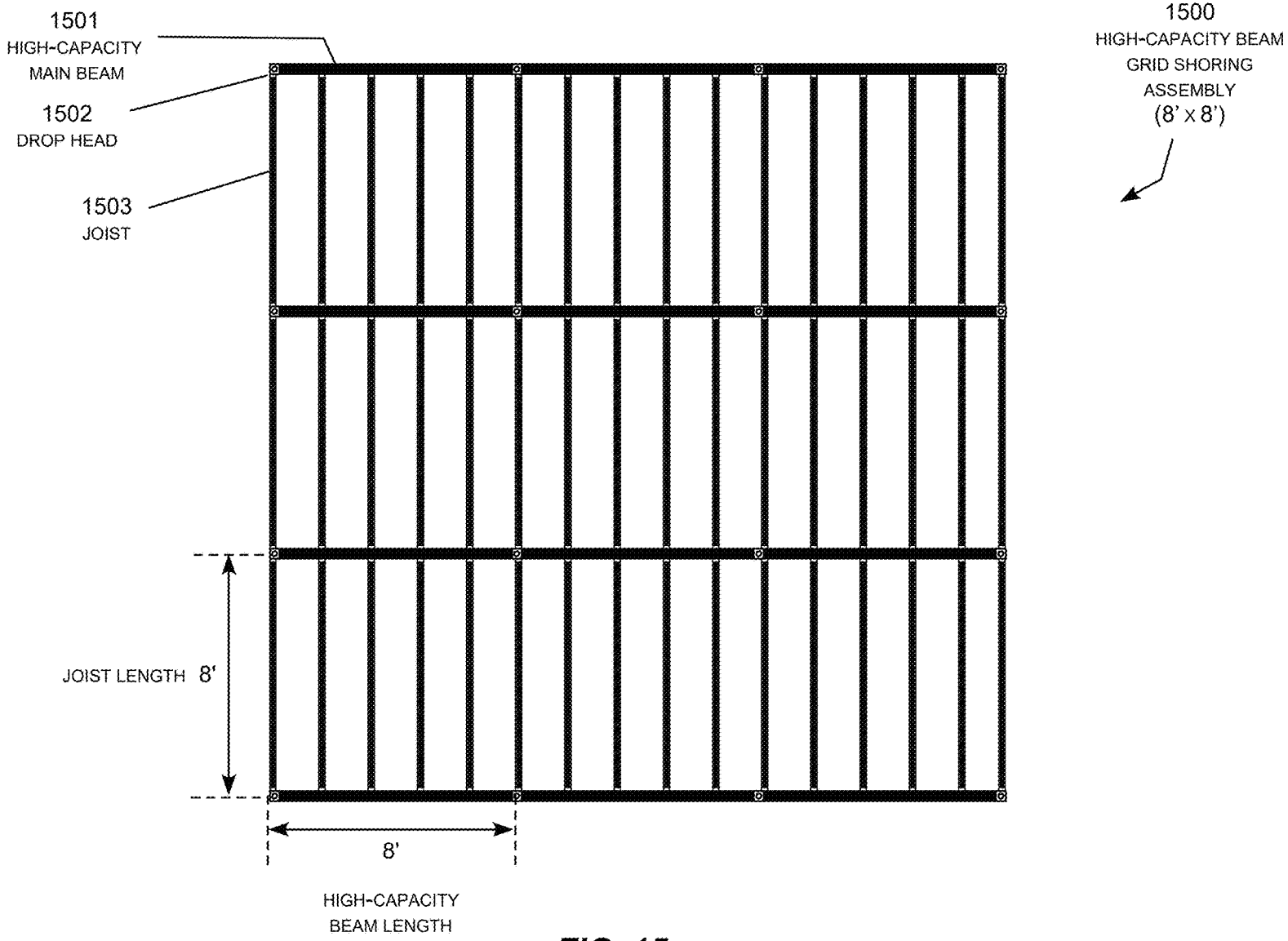
FIG. 15 shows a plan view of a third high-capacity beam grid shoring assembly.

FIG. 15 shows a plan view of a high-capacity beam grid shoring assembly 1500 utilizing nominal 8-foot high-capacity main beams and nominal 8-foot transverse joists referred to as a nominal "8-foot by 8-foot" grid shoring assembly. More specifically, the 8-foot by 8-foot grid shoring assembly includes 12 nominal 8-foot high-capacity main beams represented by the enumerated high-capacity main beam 1501. The high-capacity main beams are supported by 16 drop heads represented by the enumerated drop head 1502. The drop heads, in turn, are supported by props not shown in this figure. The high-capacity beam grid shoring assembly 1500 also includes 48 nominal 8-foot joists, represented by the enumerated joist 1503, extending transverse between the high-capacity main beams or drop heads. The high-capacity beams, joists, drop heads and props are interoperable components of the modular grid-shoring system described previously. The 8-foot by 8-foot grid shoring assembly 1500 is rated to support a nominal 13-inch concrete platform with a maximum quarter-inch vertical deflection.

A comparison of FIGS. 13-15 reveals an important advantage of the innovative high-capacity beam. Specifically, nominal 8-foot lengths of the innovative high-capacity beams can be utilized as main beams with nominal 8-foot transverse joists to create the 8-foot by 8-foot grid shoring assembly 1500 shown in FIG. 15. This 8-foot by 8-foot grid shoring assembly 1500 utilizes only 12 high-capacity main beams, 16 drop heads, and 48 transverse joists. Compare this to the 6-foot by 6-foot grid shoring assembly 1300 shown in FIG. 13 utilizing 20 high-capacity main beams, 25 drop heads, and 64 transverse joists. As a result, the design of the innovative high-capacity beam allowing it to be used to fabricate the 8-foot by 8-foot grid shoring assemblies 1500, as opposed to the 6-foot by 6-foot grid shoring assemblies 1300, significantly reduces the number of high-capacity main beams (from 20 to 12), drop heads (from 25 to 20) and transverse joists (from 64 to 48) required to assemble a grid shoring assembly rated to support a nominal 13-inch concrete platform. This produces a very significant cost advantage achieved by the innovative high-capacity beam, which only weighs about 25% more than a comparable length of the low-capacity beam.

Figure 16:
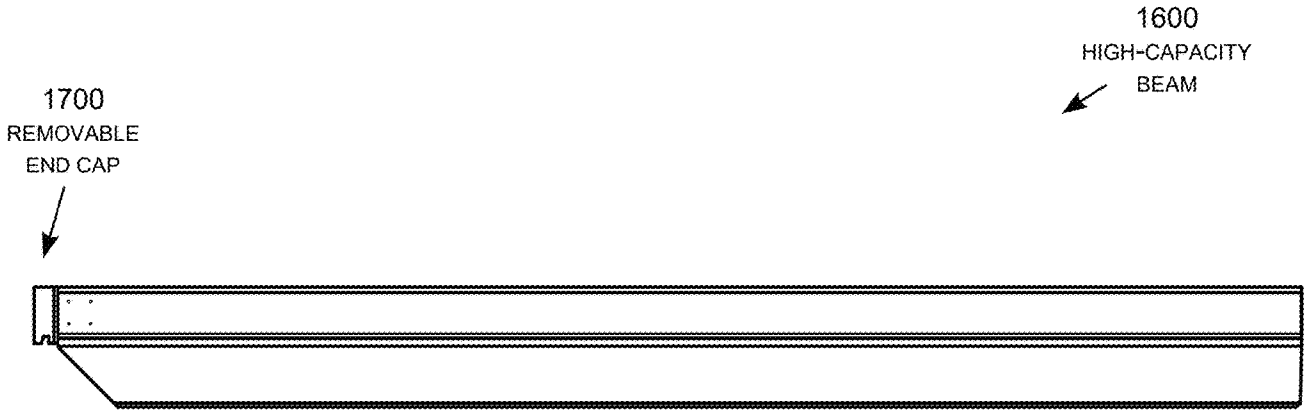
FIG. 16 is a side view of a high-capacity beam utilizing a removable end cap.

Another advantage of the modular grid shoring system is the ability to introduce new components that are interoperable with the preexisting components, provided they have appropriate conformant features. This type of backwardly compatible interoperability with the preexisting components of the modular grid shoring system is an important advantage of the innovative high-capacity beam. Other types of innovative components can thus be designed for interoperability with the innovative high-capacity beam as well as the other preexisting components of the modular grid shoring system. FIGS. 16 and 17 illustrate this type of interoperable component.

Figure 17C:
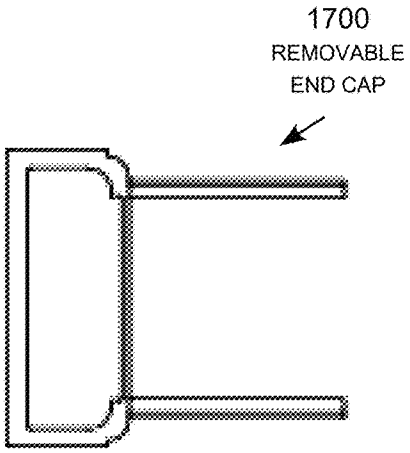
FIG. 17C is a side view of the removable end cap.
Figure 17B:
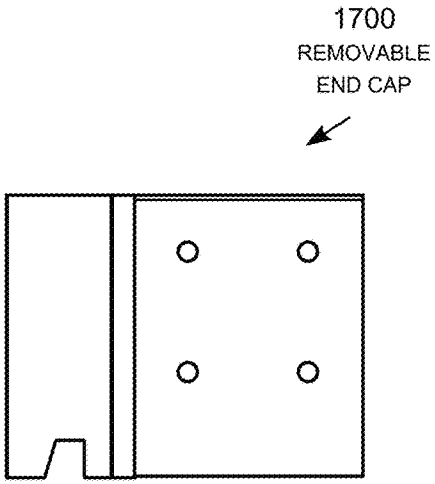
FIG. 17B is a top view of the removable end cap.
Figure 17A:
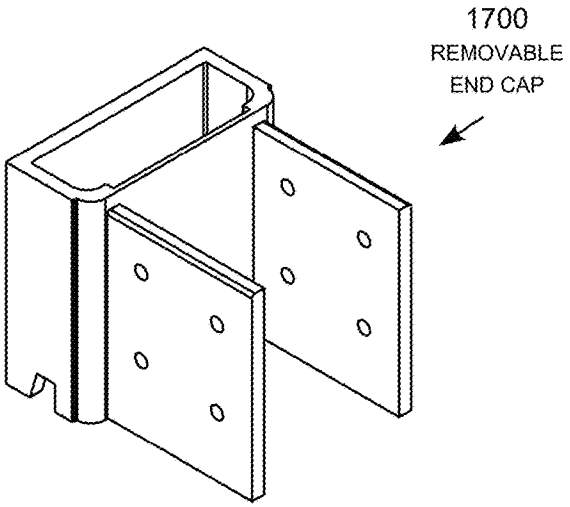
FIG. 17A is a perspective view of the removable end cap.
Figure 18C:
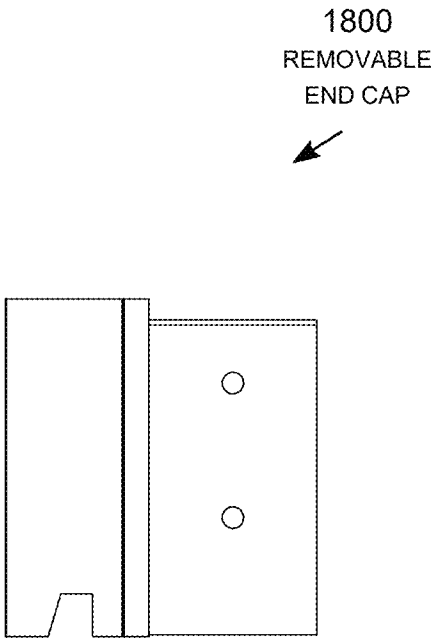
FIG. 18C is a side view of the alternate removable end cap.
Figure 18B:
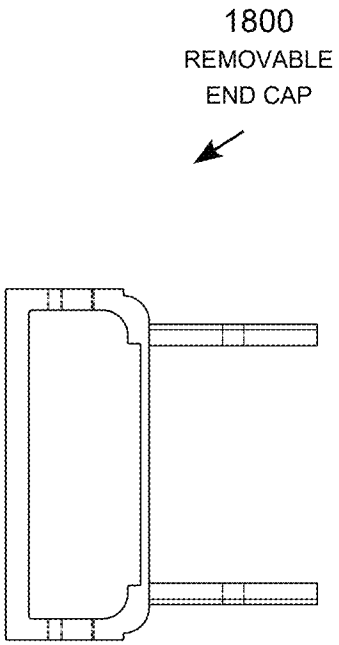
FIG. 18B is a top view of the alternate removable end cap.
Figure 18A:
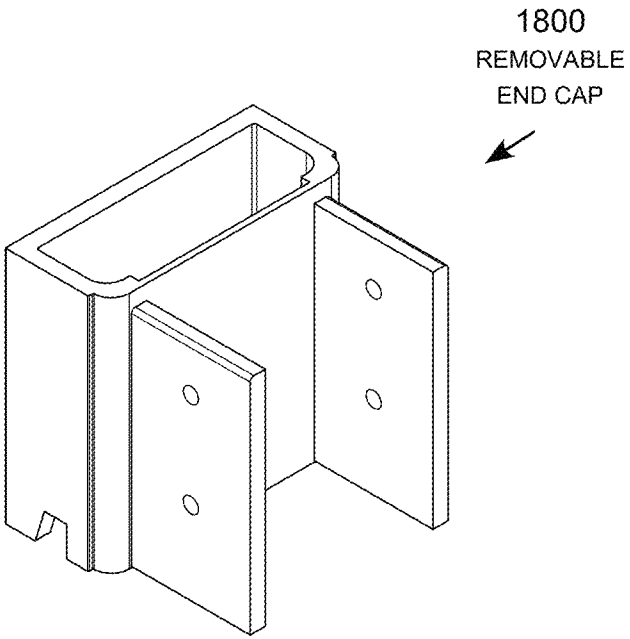
FIG. 18A is a perspective view of an alternate removable end cap.

FIG. 16 is a side view of a high-capacity beam 1600 utilizing a removable end cap 1700, which fits inside the hollow extrusion of the conformant interface portion of the beam, which it is bolted in place. While a preexisting end cap of the modular grid shoring system is permanently welded onto the end of the conformant interface portion of a beam, the removable end cap 1600 can be bolted or riveted in place, allowing the removable end cap 1600 to be readily removed and replaced as needed. For example, a damaged removable end cap 1600 can be readily removed and replaced with a new removable end cap. This particular example utilizes four bolts on each side of the removable end cap. FIG. 17A is a perspective view, FIG. 17B is a top view, and FIG. 17C is a side view of the removable end cap 1700. FIG. 18A is a perspective view, FIG. 18B is a top view, and FIG. 18C is a side view of an alternate removable end cap 1800 that utilized two bolts on each side of the removable end cap to attach the alternant end cap to the hollow extrusion of the conformant interface portion of the beam.

It should also be noted that the high-capacity beam 1600 only includes one removable end cap 1700. While modular beams are typically double-capped with end caps on both ends, the single-capped high-capacity beam 1600 is an option within the scope of the modular grid modular grid shoring system.

The present is best understood from the foregoing detailed description when read with the accompanying figures. It is emphasized that, in accordance with the standard practice in the industry, various features may not be drawn to scale. In fact, the dimensions of the various features may be arbitrarily increased or reduced for clarity of discussion. In the interest of clarity, not all features of an actual implementation are described for every example in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

As used in this disclosure, the article "a" is intended to have its ordinary meaning in the patent arts, namely "one or more." Terms of approximation, such as "about" or "approximately" a stated value generally means that the component falls within a range about the stated value such that the function or objective of the component is substantially unaffected by its precise value within the range. Similarly, the term "substantially" generally means falling within a range about the stated value such that the function or objective of the component is substantially unaffected by its precise value within the range. A term of approximation with respect to a stated value may be construed to fall within 10% of the stated value unless otherwise specified or implied from the disclosure. Moreover, the specific example in the representative embodiments are intended to be illustrative presented for discussion purposes and not by way of limitation.

The words "couple," "adjacent" and similar terms do not necessarily denote direct and immediate connections, but also include connections through intermediate elements or devices. Certain descriptors, such "first" and "second," "top and bottom," "upper" and "lower," "inner" and "outer," "leading" and "trailing, "proximal" and "distal", "vertical" and "horizontal" or similar relative terms may be employed to differentiate structures from each other in representative embodiments shown in the figures. These descriptors are utilized as a matter of descriptive convenience and are not employed to implicitly limit the presently claimed subject matter to any particular position or orientation.

The foregoing description, for purposes of explanation, used specific nomenclature to provide a thorough understanding of the disclosure. However, it will be apparent to one skilled in the art that the specific details are not required to practice the systems and methods described herein. The foregoing descriptions of specific examples are presented for purposes of illustration and description. They are not intended to be exhaustive of or to limit this disclosure to the precise forms described. Those skilled in the art will appreciate that many modifications and variations are possible in view of the above disclosure. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

The invention claimed is:

1. A high-capacity beam for supporting a nominal 13-inch thick concrete platform in a modular grid shoring system comprising low-capacity beams for supporting a nominal 6-inch thick concrete platform, comprising:

a pair of conformant interface portions extending in a longitudinal direction on opposing sides of the high-capacity beam;

each conformant interface portion defining a conformant interface rail configured for receiving conformant end caps supporting respective joists extending in a transverse direction;

each conformant interface portion further comprising a pair of conformant end caps attached to and substantially filling a frontal end face of a respective conformant interface portion;

wherein the high-capacity beam is adapted for interoperability with the low-capacity beams, joists and drop heads interoperable with the low-capacity beams;

wherein a nominal 8-foot length of the high-capacity beam weighs less than about 50 lbs.;

wherein the high-capacity beam is adapted for supporting a nominal 13-inch thick concrete platform in a grid shoring assembly-comprising nominal 8-foot lengths of the high-capacity beam extending in a longitudinal direction supporting nominal 8-foot joists extending in a transverse direction with no more than one quarter-inch vertical deflection.

2. The high-capacity beam of claim 1, wherein each nominal 8-foot length of the low-capacity beam weighs less than about 40 lbs.

3. The high-capacity beam of claim 1, wherein the conformant interface portion of the high-capacity beam has substantially the same cross-sectional dimensions as a conformant interface portion of the low-capacity beam.

4. The high-capacity beam of claim 1, wherein:

the conformant interface portion of the high-capacity beam has substantially the same cross-sectional dimensions as a conformant interface portion of the low-capacity beam;

a low-capacity truss portion of the low-capacity beam has a height less than a height of a conformant interface portion of the low-capacity beam;

a high-capacity truss portion of the high-capacity beam has a height greater than a height of the conformant interface portion of the high-capacity beam.

5. The high-capacity beam of claim 1, wherein each conformant interface portion is configured to removably receive and form flush joints with a plurality of conformant end caps of other high-capacity beams, the low-capacity beams, and the joists.

6. The high-capacity beam of claim 1, further comprising high-capacity joist and low-capacity joists, wherein each conformant interface portion is configured to removably receive and form flush joints with a plurality of conformant end caps of other high capacity beams, the low-capacity beams, the high-capacity joist, and the low-capacity joists.

7. The high-capacity beam of claim 1, wherein each conformant end cap is configured to removably receive conformant beam interfaces of a plurality of different types of drop heads.

8. The high-capacity beam of claim 4, wherein:

the low-capacity truss portion of the low-capacity beam comprises a conformant T-slot for removably receiving conformant clips and conformant prop positioners;

the high-capacity truss portion of the high-capacity beam comprises a conformant T-slot for removably receiving the conformant clips and the conformant prop positioners.

9. The high-capacity beam of claim 4, wherein the high-capacity truss portion comprises first and second beveled end faces on respective opposing ends of a respective high-capacity truss portion.

10. A modular grid shoring system comprising a set of interoperable modular grid shoring system components including high-capacity beams for supporting a nominal 13-inch thick concrete platform and low-capacity beams for supporting a nominal 6-inch thick concrete platform, joists and drop heads, each low-capacity beam comprising a pair of conformant interface portions extending in a longitudinal direction on opposing sides of the low-capacity beam, each conformant interface portion defining a conformant interface rail configured for receiving conformant end caps supporting respective joists extending in a transverse direction, each conformant interface portion further comprising a pair of conformant end caps attached to and substantially filling a frontal end face of a respective conformant interface portion, each low-capacity beam further comprising a low-capacity truss portion extending from a bottom side of the conformant interface portion, each high-capacity beam comprising:

a pair of conformant interface portions extending in a longitudinal direction on opposing sides of the high-capacity beam;

each conformant interface portion defining a conformant interface rail configured for receiving conformant end caps supporting respective joists extending in a transverse direction;

each conformant interface portion further comprising a pair of conformant end caps attached to and substantially filling a frontal end face of a respective conformant interface portion;

each high-capacity beam further comprising a high-capacity truss portion extending from a bottom side of the conformant interface portion;

wherein the high-capacity beams are adapted for interoperability with the low-capacity beams, joists and drop heads interoperable with the low-capacity beams;

wherein a nominal 8-foot lengths of the high-capacity beam weighs less than about 50 lbs.;

wherein each high-capacity beam is adapted for supporting a nominal 13-inch thick concrete platform in a grid shoring assembly comprising nominal 8-foot lengths of the high-capacity beam extending in a longitudinal direction supporting nominal 8-foot joists extending in a transverse direction with no more than one quarter-inch vertical deflection.

11. The grid shoring system of claim 10, wherein each nominal 8-foot length of the low-capacity beam weighs less than about 40 lbs.

12. The grid shoring system of claim 10, wherein the conformant interface portion of each high-capacity beam has substantially the same cross-sectional dimensions as the conformant interface portion of each low-capacity beam.

13. The grid shoring system of claim 10, wherein:

the conformant interface portion of each high-capacity beam has substantially the same cross-sectional dimensions as the conformant interface portion of each low-capacity beam;

the low-capacity truss portion of each low-capacity beam has a height less than a height of the conformant interface portion the of the low-capacity beam;

the high-capacity truss portion of each high-capacity beam has a height greater than a height of the conformant interface portion of the high-capacity beam.

14. The grid shoring system of claim 10, wherein each conformant interface portion is configured to removably receive and form flush joints with a plurality of conformant end caps of other high-capacity beams, the low-capacity beams, and the joists.

15. The grid shoring system of claim 10, further comprising high-capacity joist and low-capacity joists, wherein each conformant interface portion is configured to removably receive and form flush joints with a plurality of conformant end caps of other high-capacity beams, the low-capacity beams, the high-capacity joist, and the low-capacity joists.

16. The grid shoring system of claim 10, wherein each conformant end cap is configured to removably receive conformant beam interfaces of a plurality of different types of drop heads.

17. The grid shoring system of claim 10, wherein:

the low-capacity truss portion of each low-capacity beam comprises a conformant T-slot for removably receiving conformant clips and conformant prop positioners;

the high-capacity truss portion of each high-capacity beam comprises a conformant T-slot for removably receiving the conformant clips and the conformant prop positioners.

18. The grid shoring system of claim 10, wherein the high-capacity truss portion comprises first and second beveled end faces on respective opposing ends of a respective high-capacity truss portion.

19. A high-capacity beam for supporting a nominal 13-inch thick concrete platform in a modular grid shoring system, comprising:

a pair of interface portions extending in a longitudinal direction on opposing sides of the high-capacity beam;

each interface portion defining an interface rail configured for receiving respective joists extending in a transverse direction;

wherein a nominal 8-foot length of the high-capacity beam weighs less than about 50 lbs.;

wherein the nominal 8-foot length of the high-capacity beam is rated for supporting a nominal 13-inch thick concrete platform.

20. A high-capacity beam for supporting a nominal 13-inch thick concrete platform in a modular grid shoring system, comprising:

a pair of interface portions extending in a longitudinal direction on opposing sides of the high-capacity beam;

each interface portion defining an interface rail configured for receiving respective joists extending in a transverse direction;

wherein a nominal 8-foot length of the high-capacity beam weighs less than about 50 lbs.;

wherein the high-capacity beam is adapted for supporting a nominal 13-inch thick concrete platform in a grid shoring assembly-comprising nominal 8-foot lengths of the high-capacity beam extending in a longitudinal direction supporting nominal 8-foot joists extending in a transverse direction with no more than one quarter-inch vertical deflection.

* * * * *